US008918011B2

(12) United States Patent
Yamasaki et al.

(10) Patent No.: US 8,918,011 B2
(45) Date of Patent: Dec. 23, 2014

(54) UNIT AND IMAGE FORMING APPARATUS

(71) Applicant: Canon Kabushiki Kaisha, Tokyo (JP)

(72) Inventors: Toshiteru Yamasaki, Yokohama (JP); Akira Suzuki, Naka-gun (JP); Akiko Taira, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 48 days.

(21) Appl. No.: 13/670,627

(22) Filed: Nov. 7, 2012

(65) Prior Publication Data

US 2013/0129375 A1 May 23, 2013

(30) Foreign Application Priority Data

Nov. 9, 2011 (JP) ..... 2011-245731
Dec. 16, 2011 (JP) ..... 2011-275772
Dec. 16, 2011 (JP) ..... 2011-275773

(51) Int. Cl.
*G03G 15/08* (2006.01)
*G03G 21/18* (2006.01)
*G03G 21/00* (2006.01)

(52) U.S. Cl.
CPC ..... *G03G 15/0898* (2013.01); *G03G 21/1832* (2013.01); *G03G 21/0029* (2013.01); *G03G 2215/0877* (2013.01)
USPC ..... 399/105

(58) Field of Classification Search
CPC ..... G03G 15/0898
USPC ..... 399/105, 103
See application file for complete search history.

(56) References Cited

U.S. PATENT DOCUMENTS 5,389,732 A * 2/1995 Sekino ..... 399/103
5,884,124 A 3/1999 Karakama et al.
5,966,567 A 10/1999 Matsuzaki et al.
6,144,815 A 11/2000 Chadani et al.
6,154,623 A 11/2000 Suzuki et al.
6,173,140 B1 1/2001 Suzuki et al.
6,173,145 B1 1/2001 Chadani et al.
6,205,305 B1 3/2001 Suzuki et al.
6,219,504 B1 4/2001 Matsuzaki et al.
6,246,853 B1 6/2001 Suzuki et al.

(Continued)

FOREIGN PATENT DOCUMENTS

EP 1 162 515 A2 12/2001
EP 1 560 078 A1 3/2005
JP 3231848 10/1991

OTHER PUBLICATIONS

PCT International Search Report in International Application No. PCT/JP2012/079575, dated Jun. 4, 2013.

*Primary Examiner* — Clayton E LaBalle
*Assistant Examiner* — Leon W Rhodes, Jr.
(74) *Attorney, Agent, or Firm* — Fitzpatrick, Cella, Harper & Scinto

(57) ABSTRACT

A unit for use with an image forming apparatus. The unit includes a developer accommodating portion, constituted by a frame, for accommodating a developer. A sheet member, provided on the frame in contact with a rotatable member, prevents the developer from leaking out from a gap between the developer accommodating portion and the rotatable member. A resin member fixes the sheet member on the frame. The resin member is formed on the frame by injection molding of a resin material and is fixed to the sheet member by welding. The resin material has an elastic modulus that is less than that of the frame.

32 Claims, 25 Drawing Sheets

(56) References Cited

U.S. PATENT DOCUMENTS

| | | | | |
|---|---|---|---|---|
| 6,282,389 | B1 | 8/2001 | Matsuzaki et al. | |
| 6,415,121 | B1 | 7/2002 | Suzuki et al. | |
| 6,549,736 | B2 | 4/2003 | Miyabe et al. | |
| 6,654,578 | B2 | 11/2003 | Suzuki et al. | |
| 6,771,920 | B2 | 8/2004 | Abe et al. | |
| 6,795,666 | B2 | 9/2004 | Miyabe et al. | |
| 6,868,243 | B2 | 3/2005 | Watanabe et al. | |
| 6,907,210 | B2 * | 6/2005 | Wazana et al. | 399/109 |
| 6,931,226 | B2 | 8/2005 | Chadani et al. | |
| 6,934,485 | B2 | 8/2005 | Miyabe et al. | |
| 7,099,607 | B2 | 8/2006 | Suzuki et al. | |
| 7,343,218 | B2 * | 3/2008 | Caldwell et al. | 700/166 |
| 7,366,439 | B2 | 4/2008 | Anan et al. | |
| 7,933,534 | B2 | 4/2011 | Hoshi et al. | |
| 8,204,414 | B2 * | 6/2012 | Kondo et al. | 399/274 |
| 8,442,414 | B2 * | 5/2013 | Kubota et al. | 399/103 |
| 2007/0189802 | A1 * | 8/2007 | Maeda et al. | 399/101 |
| 2007/0248378 | A1 | 10/2007 | Murakami et al. | |
| 2011/0170903 | A1 | 7/2011 | Hoshi et al. | |
| 2013/0022368 | A1 | 1/2013 | Takarada et al. | |
| 2013/0114972 | A1 | 5/2013 | Takarada et al. | |
| 2013/0121720 | A1 | 5/2013 | Hoshi et al. | |
| 2013/0129377 | A1 | 5/2013 | Satomura et al. | |
| 2013/0170851 | A1 | 7/2013 | Takarada et al. | |

* cited by examiner (a)

(b)

(a)

(b)

(a)

(b)

(a)

(b)

UNIT AND IMAGE FORMING APPARATUS

FIELD OF THE INVENTION AND RELATED ART

The present invention relates to a unit and an image forming apparatus.

In the image forming apparatus for forming an image on a recording material by using an electrophotographic image forming process, a constitution including a process cartridge detachably mountable to a main assembly of the image forming apparatus has been known. The process cartridge is prepared by integrally assembling an electrophotographic photosensitive member and a process means acting on the electrophotographic photosensitive member into a unit, and the process means includes at least one of a charging means, a developing means and a cleaning means. According to the process cartridge of this type, maintenance of the image forming apparatus can be performed by a user himself (herself) without relying on a service person, so that operativity can be remarkably improved. Therefore, the process cartridge system has been widely used in the electrophotographic image forming apparatus. Examples of the electrophotographic image forming apparatus may include an electrophotographic copying machine, an electrophotographic printer (laser beam printer, LED printer or the like), a facsimile machine and the like.

A conventional process cartridge will be described with reference to FIGS. 25 to 28. FIG. 25 is a schematic sectional view of the conventional process cartridge. FIG. 26 is a schematic view when an initial tension is applied to a receptor sheet 203. FIG. 27 is a schematic view showing a state change for illustrating deviation of each of interfaces among a cleaning container 201, a double-side tape 204 and the receptor sheet 203 when an environment is changed in the order of normal temperature (e.g., 23° C.), high temperature (e.g., 50° C.) and normal temperature (e.g., 23° C.). FIG. 28 is a schematic view for illustrating a state in which an edge of the receptor sheet 203 mounted on the cleaning container 201 is waved (undulated).

Generally, in the electrophotographic image forming apparatus, the following steps are repeated during image formation. First, an electrostatic latent image is formed on an electrophotographic image bearing member (image bearing member 202) having a photosensitive layer at an outer peripheral surface. The electrostatic latent image is developed (visualized) as an image with a developer fed from the developing means via a developer carrying member 302, and then the resultant image is transferred onto a transfer material (developer image receiving material). Further, after an image forming process is ended, the developer and other deposited matters which remain on the surface of the image bearing member are sufficiently removed by the cleaning means before start of a subsequent image forming process.

As an example of the cleaning means, there is a means constituted by a cleaning blade 205, the receptor sheet 203 and the cleaning container 201. The cleaning blade 205 is used for scraping off a toner remaining on the image bearing member 202, and the receptor sheet 203 is used for scooping (receiving) the scraped toner. These members 205 and 203 are provided in contact with the surface of the image bearing member 202. The cleaning container 201 is provided with a residual toner chamber 200 for storing the scooped residual toner. The receptor sheet 203 is formed of biaxially-oriented polyester and is applied onto the cleaning container 201 at a predetermined position (mounting surface) with the double-side tape 204. The receptor sheet 203 contacting the image bearing member 202 is required to be applied onto the cleaning container 201 with high accuracy without causing the waving or the like at its edge portion. This is because, in the case where the receptor sheet 203 is not applied with high accuracy, the edge of the receptor sheet 203 cannot completely contact intimately the surface of the image bearing member 202 and as a result, the developer scraped off by the cleaning blade 205 cannot be scooped with reliability (Japanese Patent No. 3231848). Further, in order to prevent the waving of the receptor sheet 203 at the edge portion, a tension is applied to the edge of the receptor sheet 203, so that the receptor sheet 203 is applied onto the cleaning container 201 so as to obtain an amount of curvature (initial tension amount) m (FIG. 26). Incidentally, image bearing member end portion seal members 206*a* and 206*b* and a charging roller 207 are provided. Further, in the case where the double-side tape 204 is applied so as to protrude toward the image bearing member 202, the receptor sheet 203 is applied along the double-side tape 204 as shown in FIG. 39. When the receptor sheet 203 is applied in such a manner, an edge 203*a* of the receptor sheet 203 cannot completely contact intimately the surface of the image bearing member 202 and as a result, the receptor sheet cannot reliably scoop the developer scraped off by the cleaning blade 205. In order to prevent such an incomplete application state, a width o1 of a mounting surface 201*a* of the cleaning container 201 is sufficiently ensured so that the double-side tape 204 protrudes toward the image bearing member 202 (Japanese Patent No. 3231848).

Further, as an example of the developing means, there is a means including a developing blade unit 305 and a blowoff preventing sheet 303. The developing blade unit 305 is used for regulate a thickness of a layer of the developer carried on the developer carrying member 302 in an upstream side with respect to a rotational direction of the developer carrying member 302. The blowoff preventing sheet is used for preventing the blowoff (leakage) of the developer from inside to outside of the developing container 301. These developing blade unit 305 and blowoff preventing sheet 303 are provided in contact with the surface of the developer carrying member 302. Further, the blowoff preventing sheet 303 is formed of biaxially-oriented polyester and is applied onto the developing container 301 at a predetermined position (mounting surface) with a double-side tape 304. Also with respect to the blowoff preventing sheet 303, similarly as in the case of the receptor sheet 203 described above, there is a need to apply the blowoff preventing sheet 303 onto the developing container 301 with high reliability without causing the waving or the like at an edge portion. This is because, in the case where the blowoff preventing sheet 303 is not applied with high accuracy, the edge of the blowoff preventing sheet 303 cannot completely contact intimately the surface of the developer carrying member 302 and as a result, the developer in the developing container 301 is blown off from a gap therebetween. Further, similarly as in the case of the receptor sheet 203, in order to prevent the waving of the blowoff preventing sheet 303 at the edge portion, a tension is applied to the edge of the blowoff preventing sheet 303, so that the blowoff preventing sheet 303 is applied onto the developing container 301 so as to obtain an amount of curvature (initial tension amount). Incidentally, developer carrying member end portion seal members 306*a* and 306*b* are provided.

As described above, the receptor sheet 203 and the blowoff preventing sheet 303 (hereinafter, these sheets are referred to as a thin plate member) are applied onto the cleaning container 201 or the developing container 301 (hereinafter, these containers are referenced to as a frame) by using the double-side tapes. Further, their application positions are important since they largely affect developer leakage prevention from the frames. For this reason, there is a need to apply the double-side tape onto the frame with high accuracy in order to prevent the leakage of the developer, and the prevention of the waving of the thin plate member edge is important. The thin plate member is required to prevent the waving of the thin plate member edge with respect to a change in temperature (e.g., 0° C. to 50° C.) at a periphery of an associated cartridge in the image forming apparatus during rest (stop) and operation of the image forming apparatus.

For example, as shown in FIG. 27, in the case where the cartridge is left standing in the environment in the order of normal temperature (e.g., 23° C.), high temperature (e.g., 50° C.) and NT (e.g., 23° C.), each of the members is elongated corresponding to its linear expansion coefficient. In this case, the double-side tape 204 deviates (shifts) at an interface thereof with each of the cleaning container 201 and the receptor sheet 203, thus absorbing a difference in elongation between the cleaning container 201 and the receptor sheet 203. Further, in some cases, the deviation cannot be restored to an original state when the temperature is returned to the normal temperature and remains as y1 and y2. At this time, in the case where the amount of curvature (initial tension amount) m is insufficient, the curvature amount m becomes small, so that waving W as shown in FIG. 28 is generated in some cases.

In recent years, in a cartridge assembling step by an automatic machine, in order to further reduce a cost, improvements in manufacturing efficiency and product manufacturing accuracy are required. Further, with improvements in performance and image quality of the electrophotographic image forming apparatus, downsizing of the cartridge is required. However, in the above-described bonding (application) method in which the thin plate member is applied onto the frame with the double-side tape, the following problems arose. The double-side tape is soft and therefore when a width of the double-side tape is made small for the purposes of the cost reduction and the downsizing of the cartridge, meandering of the double-side tape is generated and thus it is difficult to apply the thin plate member onto the cartridge frame with high accuracy. Further, after the cartridge is left standing in the high temperature environment, the deviation is generated at the interface between the double-side tape and the thin plate member and at the interface between the double-side tape and the cartridge frame and thus the curvature amount m is decreased, so that the initial tension of the thin plate member is attenuated. For that reason, there was a need to control the tension amount of the thin plate member edge in consideration of the initial tension attenuation.

SUMMARY OF THE INVENTION

A principal object of the present invention is to provide a unit and an image forming apparatus which are capable of mounting a sheet member on a frame with high accuracy.

According to an aspect of the present invention, there is provided a unit for use with an image forming apparatus, comprising: a developer accommodating portion, constituted by a frame, for accommodating a developer; a sheet member, provided on the frame in contact with a rotatable member, for preventing the developer from leaking out from between the developer accommodating portion and the rotatable member; and a resin member for fixing the sheet member on the frame, wherein the resin member is formed on the frame by injection molding of a resin material and is fixed to the sheet member by welding.

These and other objects, features and advantages of the present invention will become more apparent upon a consideration of the following description of the preferred embodiments of the present invention taken in conjunction with the accompanying drawings.

Figure 9:
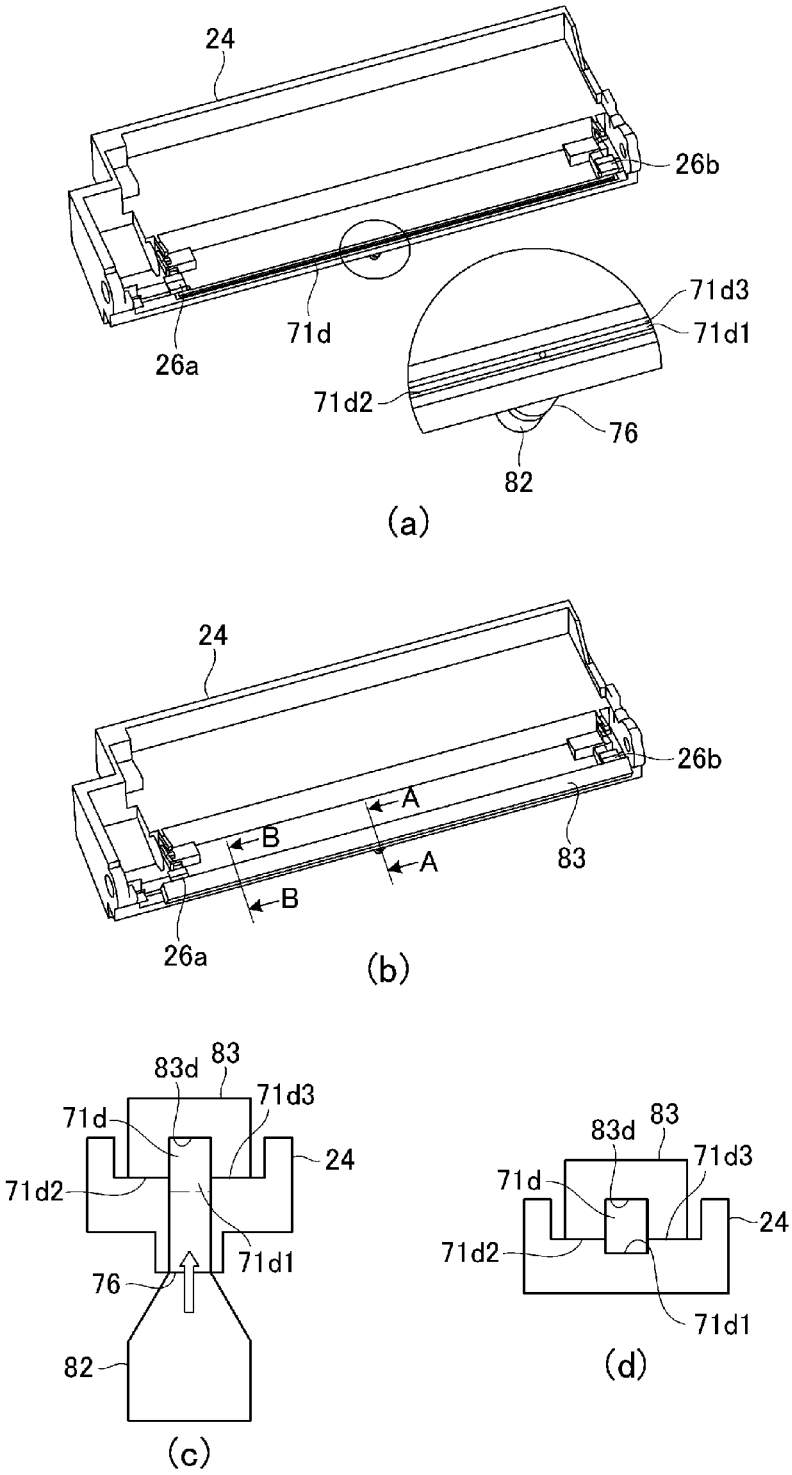

Parts (a) to (d) of FIG. 9 are schematic views for illustrating molding of an elastomer member in Embodiment 1.

Figure 10:
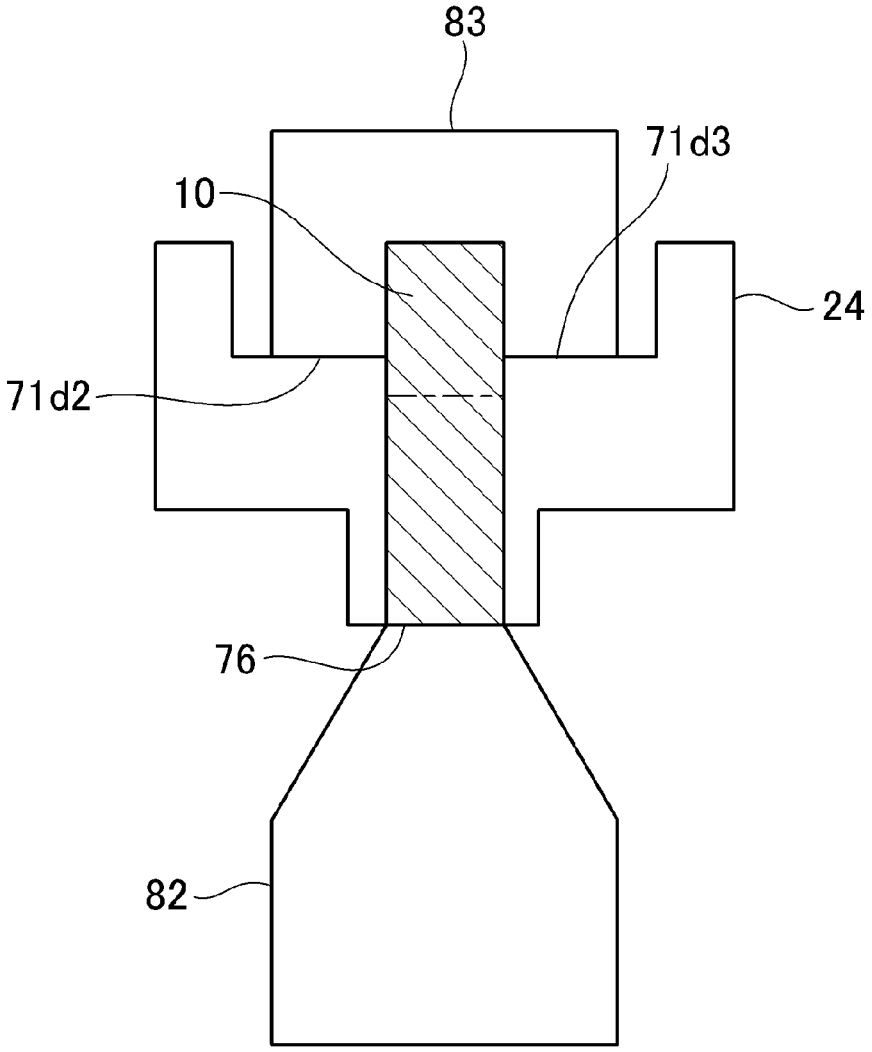

FIG. 10 is a schematic sectional view for illustrating the molding of the elastomer member in Embodiment 1 taken along A-A line indicated in (b) of FIG. 9.

Figure 11:
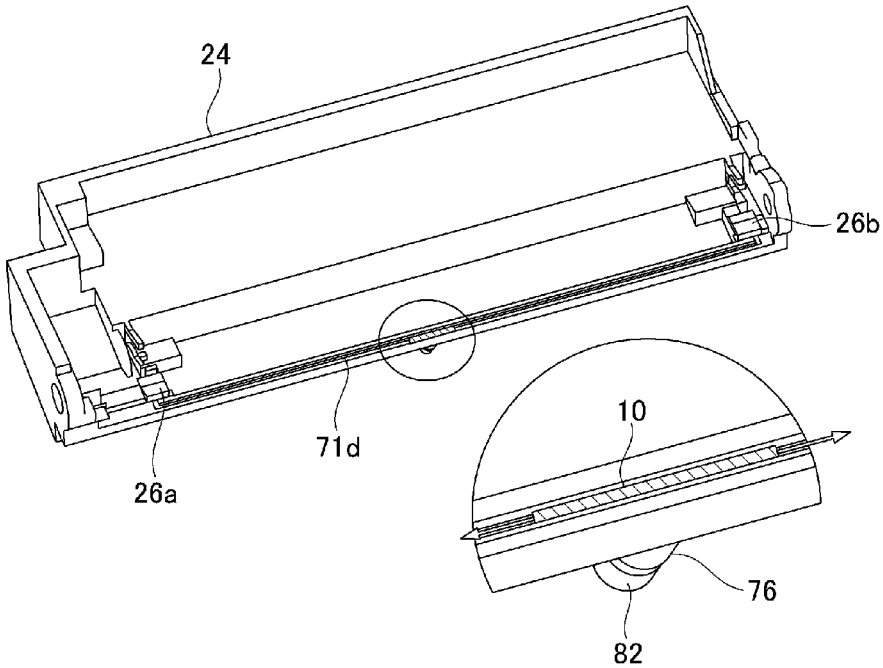

FIG. 11 is a schematic view showing a state of the elastomer member during molding in Embodiment 1.

Parts (a) and (b) of each of FIGS. 12 to 17 are structural illustrations showing a molded shape of the elastomer member in Embodiment 1.

Figure 18:
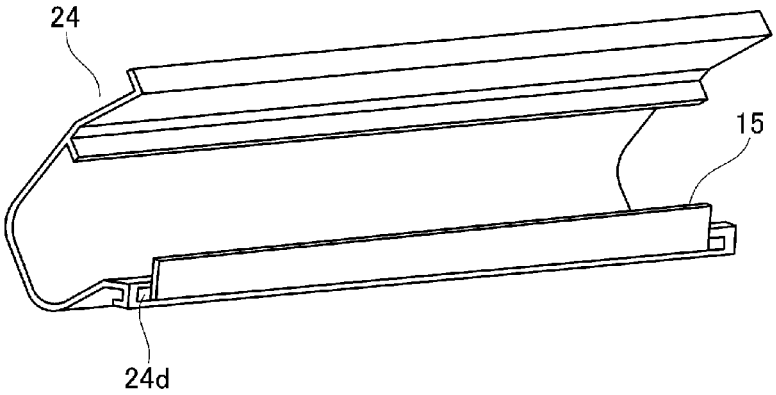
Figure 18:
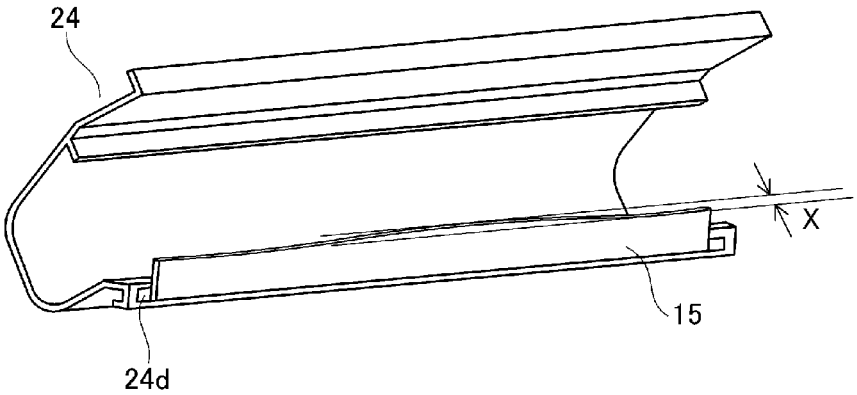

Parts (a) and (b) of FIG. 18 are illustrations of a cleaning container on which a receptor sheet is mounted in Embodiment 1.

Figure 19:
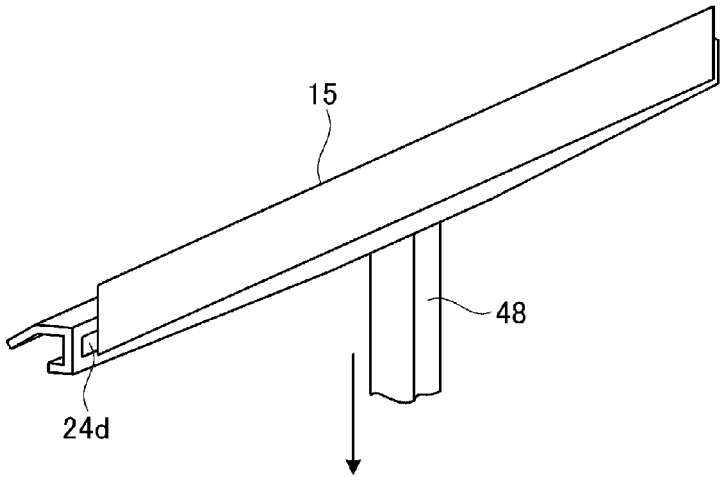
Figure 19:
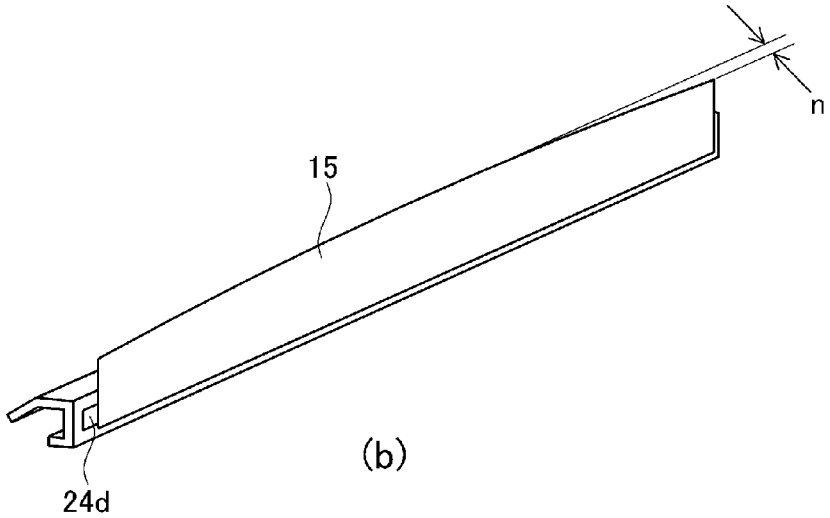

Parts (a) and (b) of FIG. 19 are schematic views for illustrating a method of applying tension to an upper edge of the receptor sheet in Embodiment 1.

Figure 20:
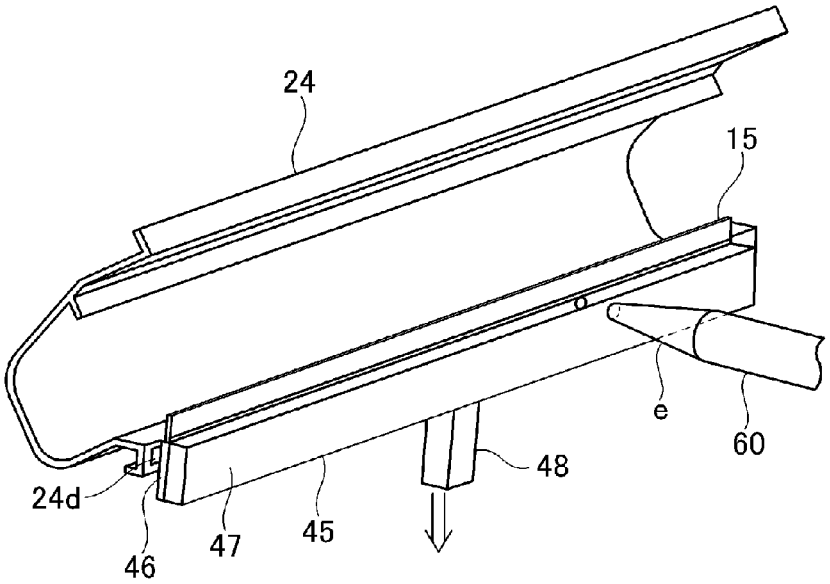

FIG. 20 is an illustration showing a state in which the elastomer member is melted to weld a sheet in Embodiment 1.

Figure 21:
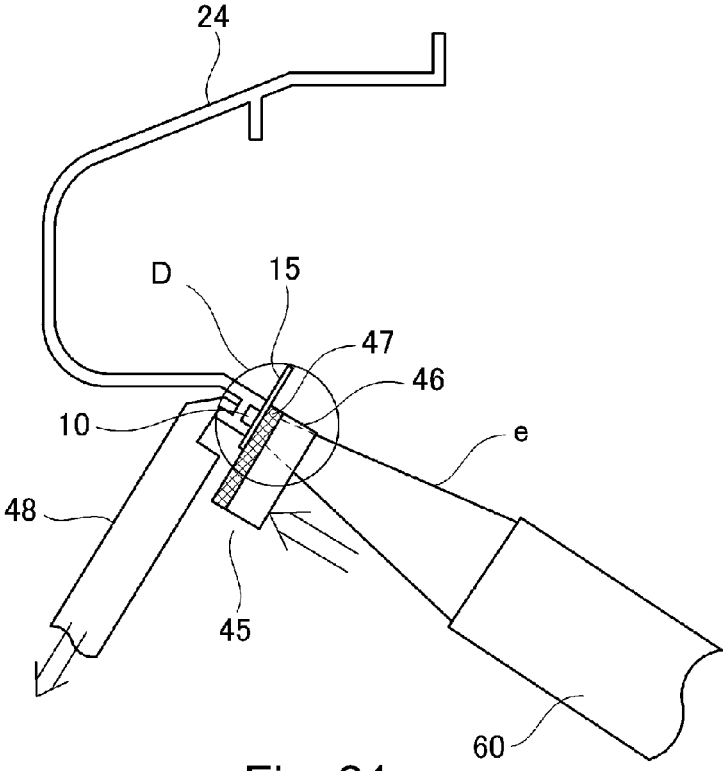

FIG. 21 is a schematic sectional view showing the state in which the elastomer member is melted to weld the sheet in Embodiment 1.

Figure 22:
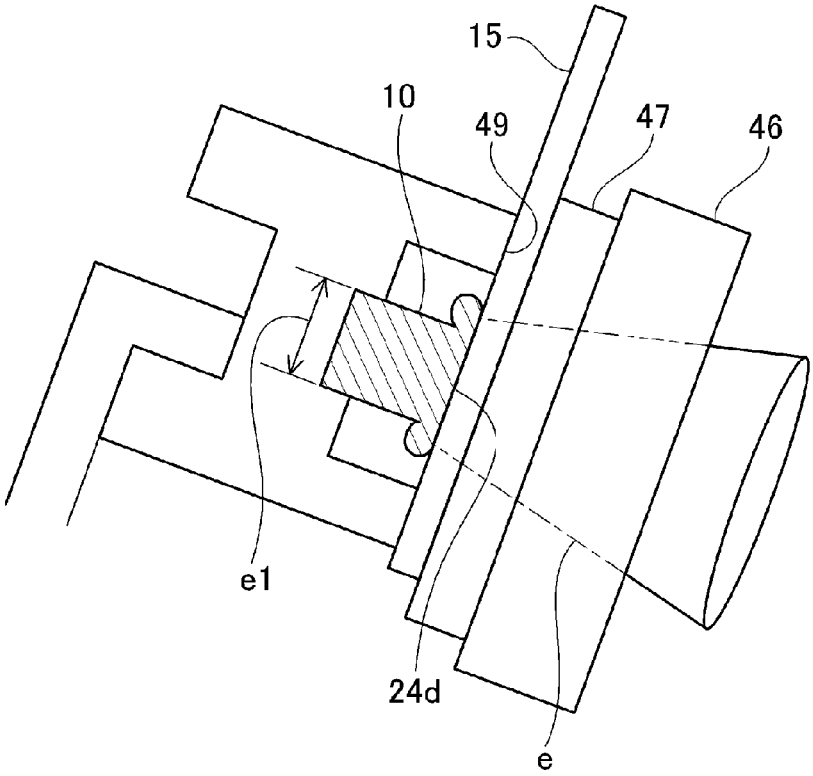

FIG. 22 is an enlarged view of D portion, indicated in FIG. 21, showing the state in which the elastomer member is melted to weld the sheet in Embodiment 1.

Figure 23:
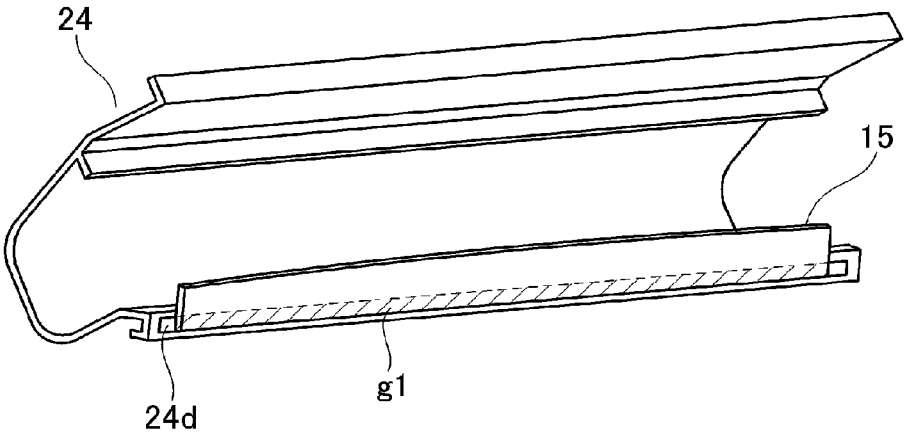

FIG. 23 is an illustration showing the cleaning container on which the receptor sheet is welded in Embodiment 1.

Figure 24:
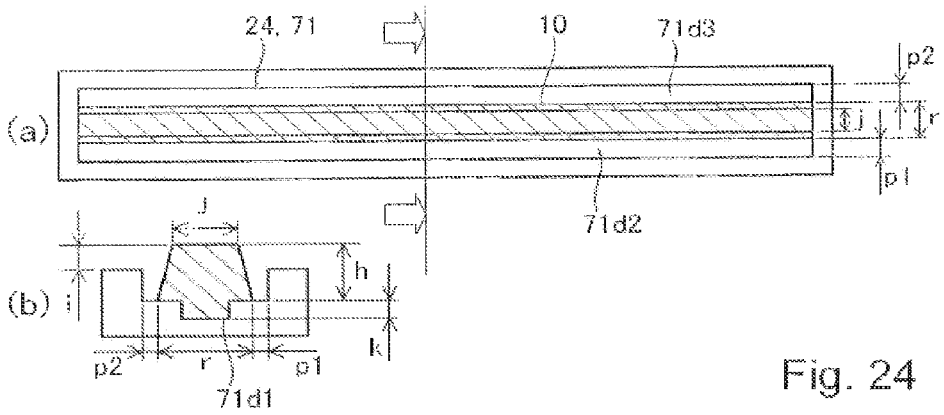

Parts (a) and (b) of FIG. 24 are schematic views showing a molded shape of the elastomer member in Embodiment 1.

Figure 25:
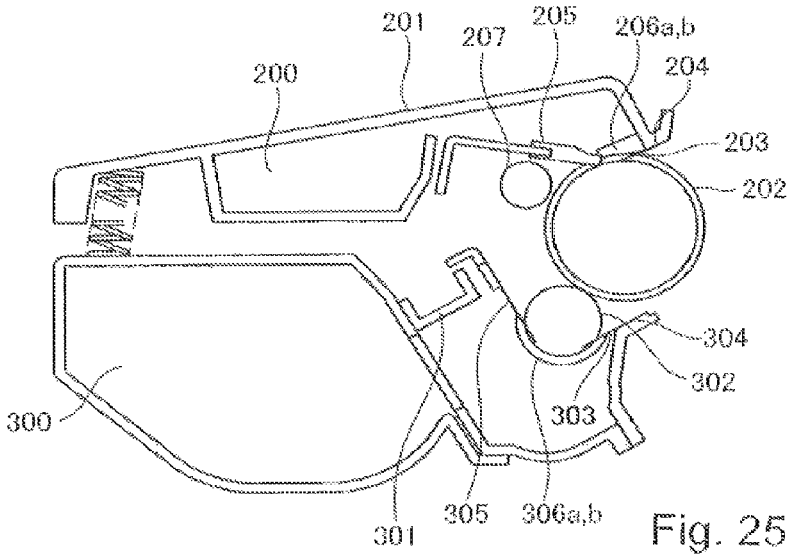
Fig. 25 PRIOR ART

FIG. 25 is a schematic sectional view of a conventional process cartridge.

Figure 26:
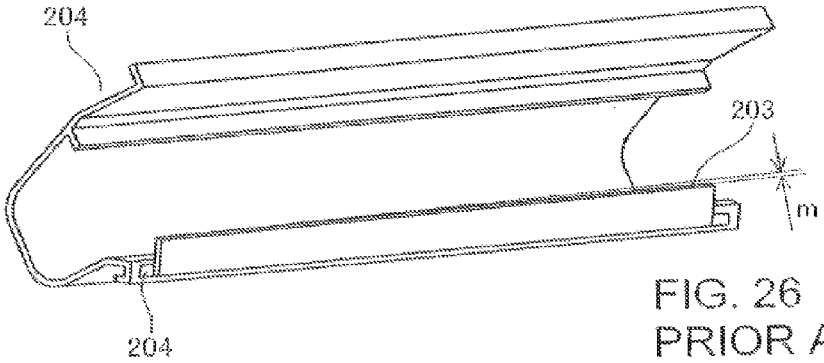
FIG. 26 PRIOR ART

FIG. 26 is a schematic view showing a cleaning container and a receptor sheet when initial tension is applied to the receptor sheet.

Figure 27:
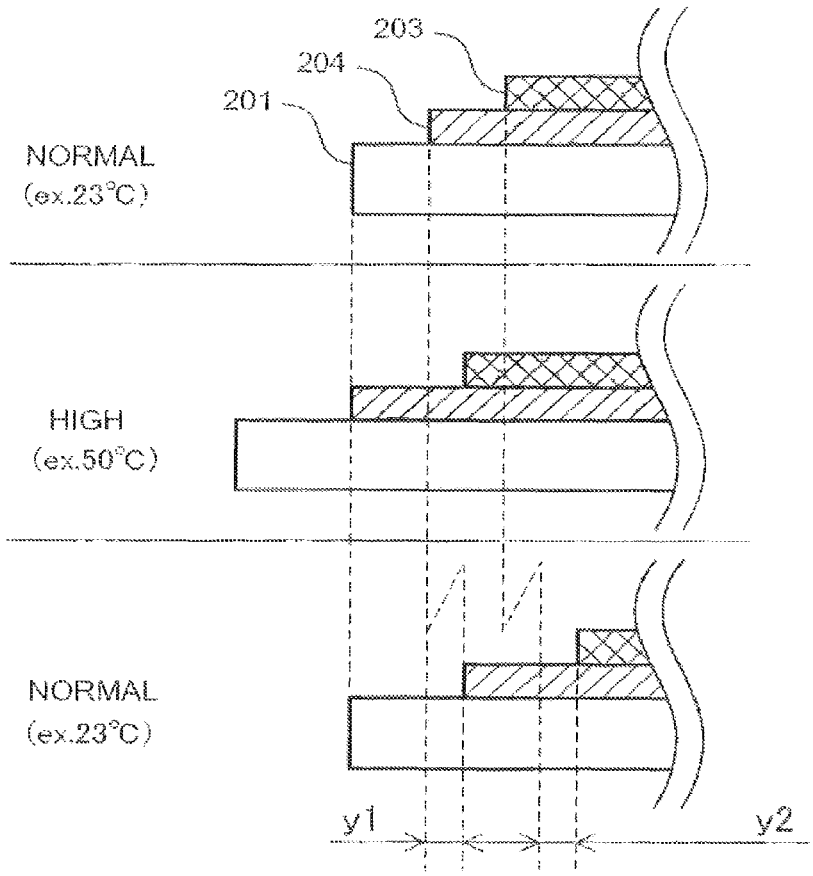
Fig. 27 PRIOR ART

FIG. 27 is a schematic view showing a change in state of interfacial deviation in environments of normal temperature and high temperature.

Figure 28:
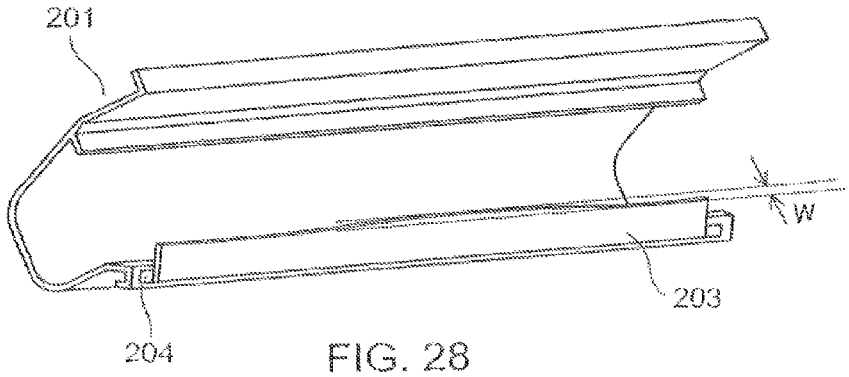
FIG. 28 PRIOR ART

FIG. 28 is an illustration showing a waving state of an upper edge of the receptor sheet.

Figure 29:
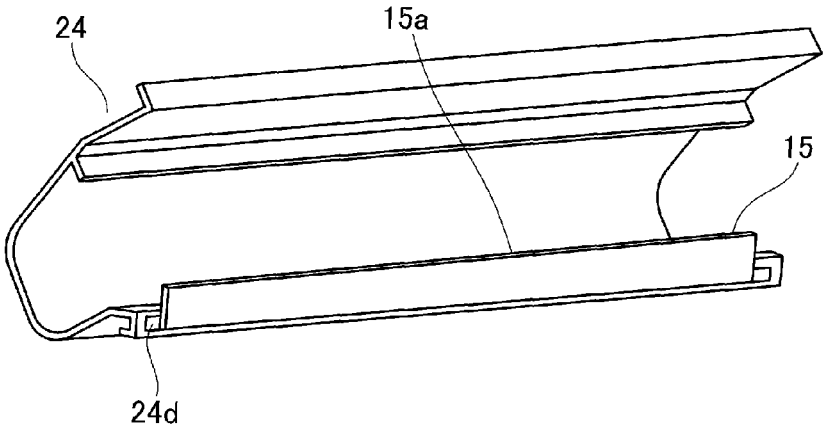
Figure 29:
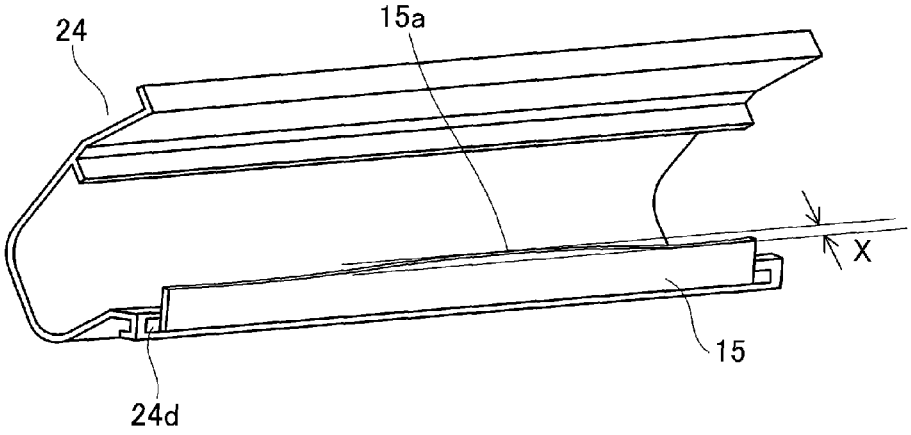

Parts (a) and (b) of FIG. 29 are schematic sectional views showing a cleaning container on which a receptor sheet is mounted in Embodiment 2.

Figure 30:
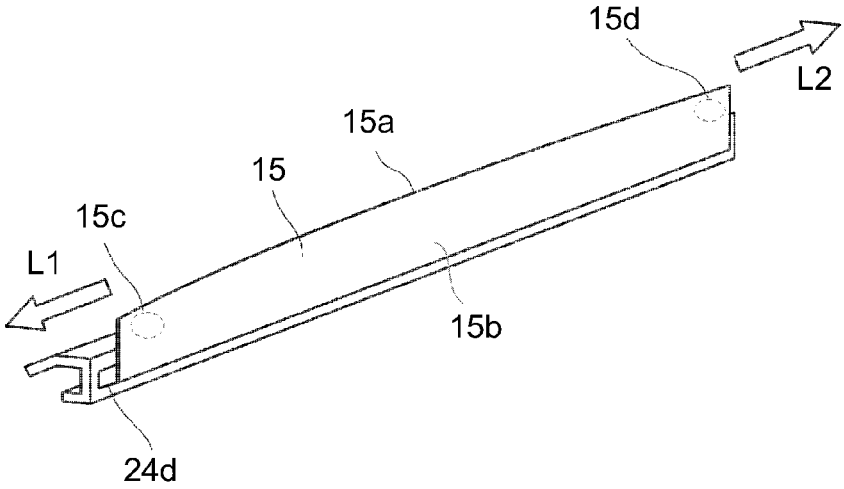
Figure 30:
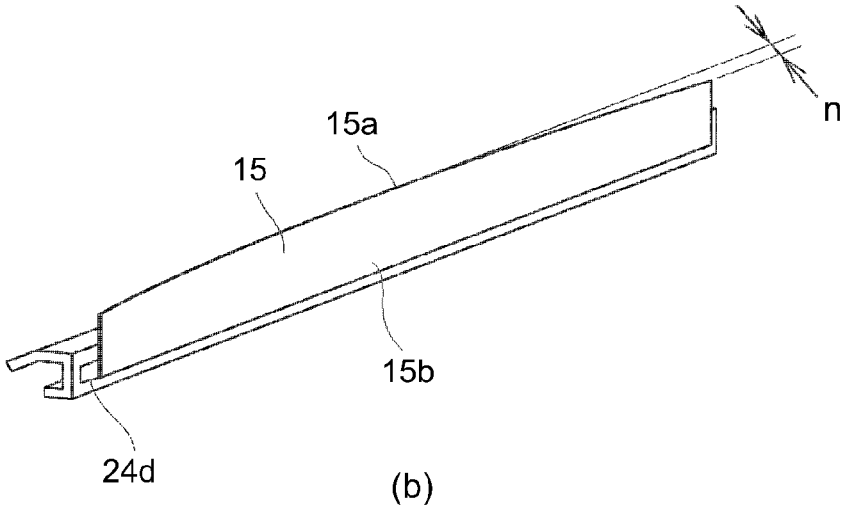

Parts (a) and (b) of FIG. 30 are schematic views for illustrating a method of applying tension to the sheet with a tension tool in Embodiment 2.

Figure 31:
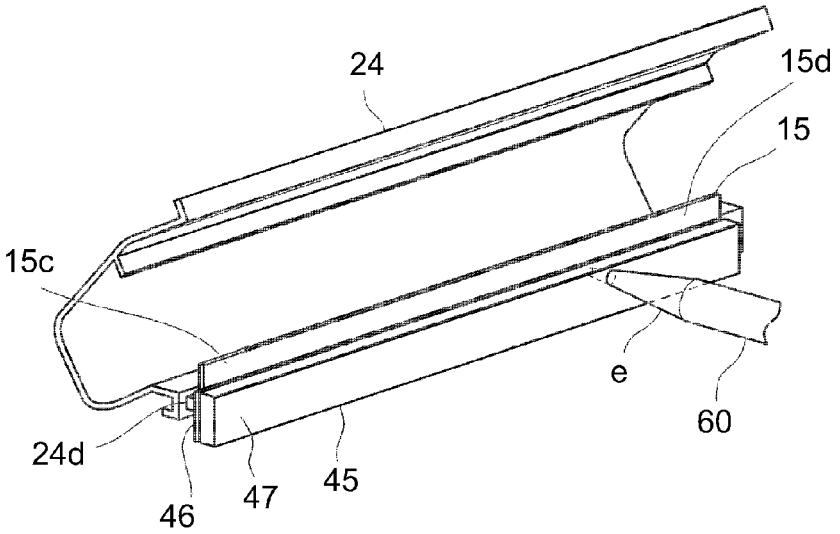

FIG. 31 is an illustration of sheet welding.

Figure 32:
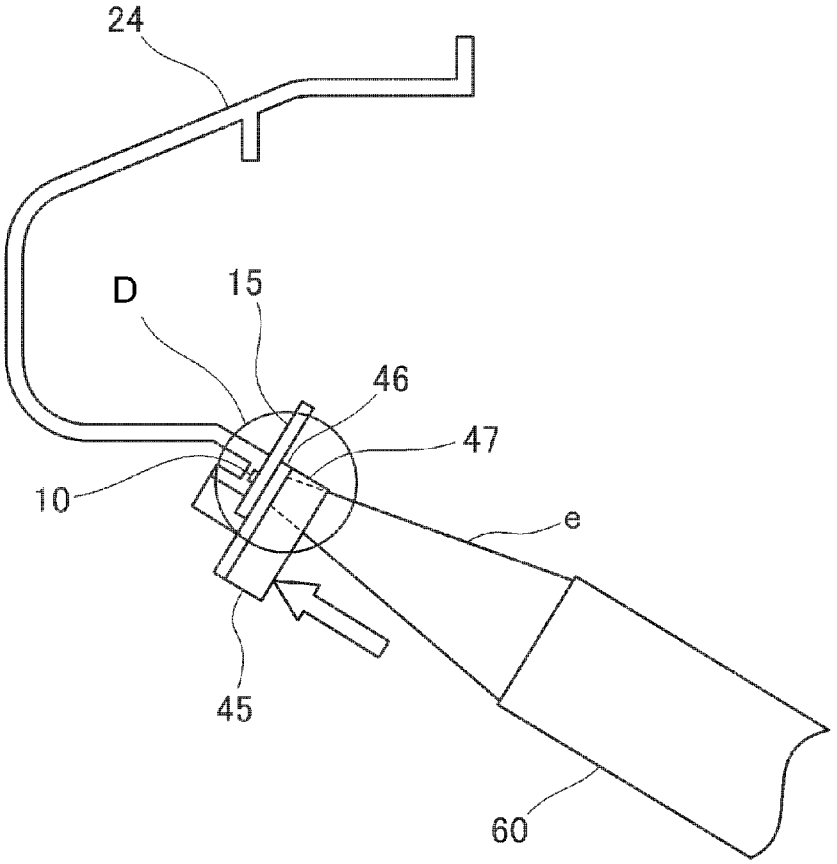

FIG. 32 is a schematic sectional view for illustrating the sheet welding.

Figure 33:
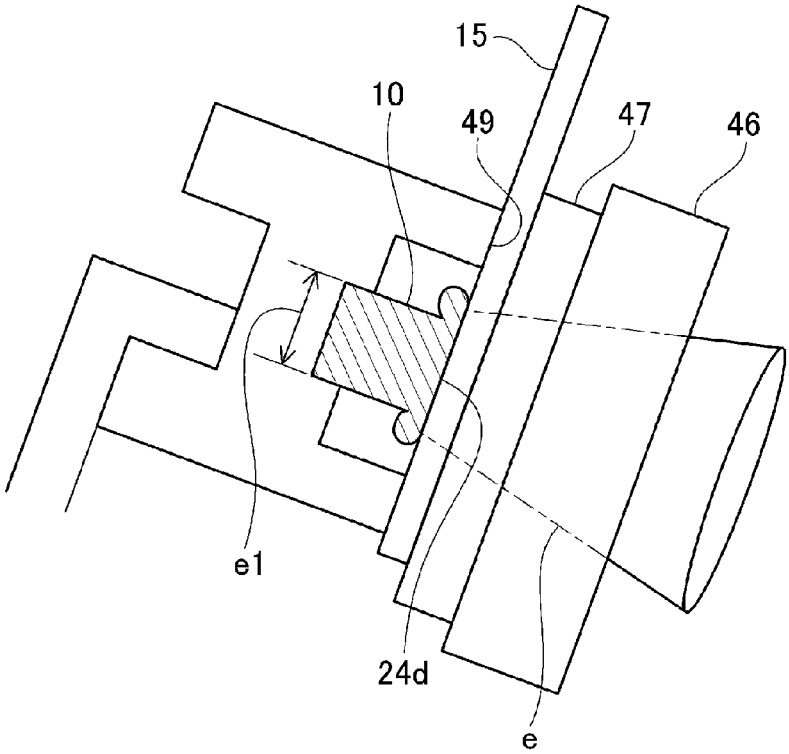

FIG. 33 is an enlarged view of D portion indicated in FIG. 32 in Embodiment 2.

Figure 34:
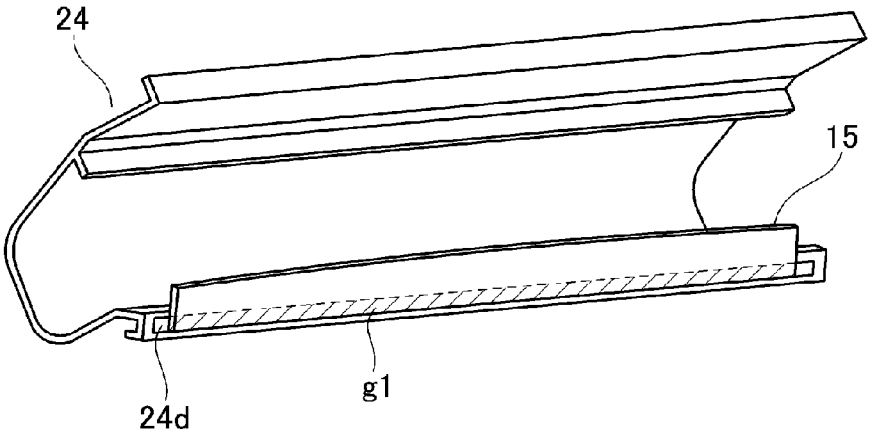

FIG. 34 is an illustration showing the cleaning container on which the receptor sheet is welded in Embodiment 2.

Figure 35:
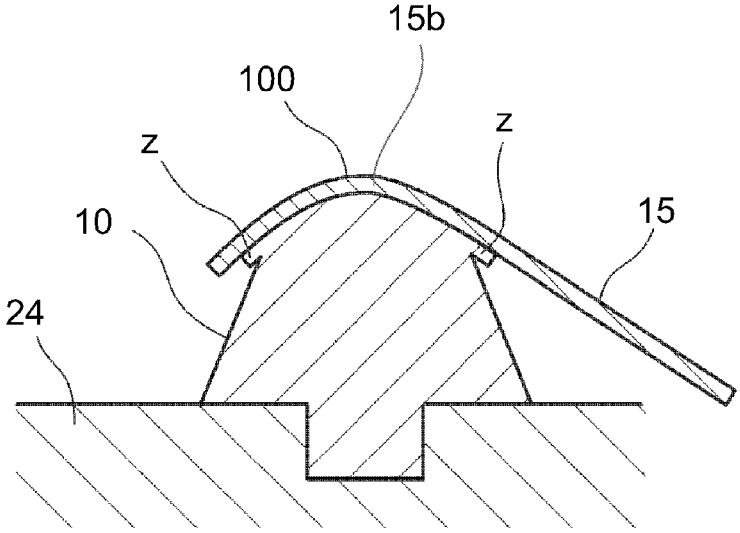

FIG. 35 is a schematic sectional view showing a state in which the receptor sheet is welded in Embodiment 2.

Figure 36:
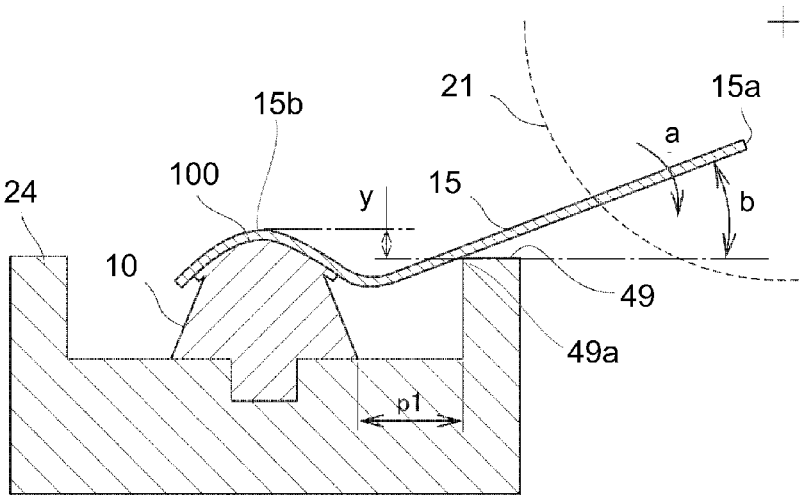

FIG. 36 is a schematic sectional view showing a state in which the receptor sheet is contacted to a sheet-regulating surface in Embodiment 2.

Figure 37:
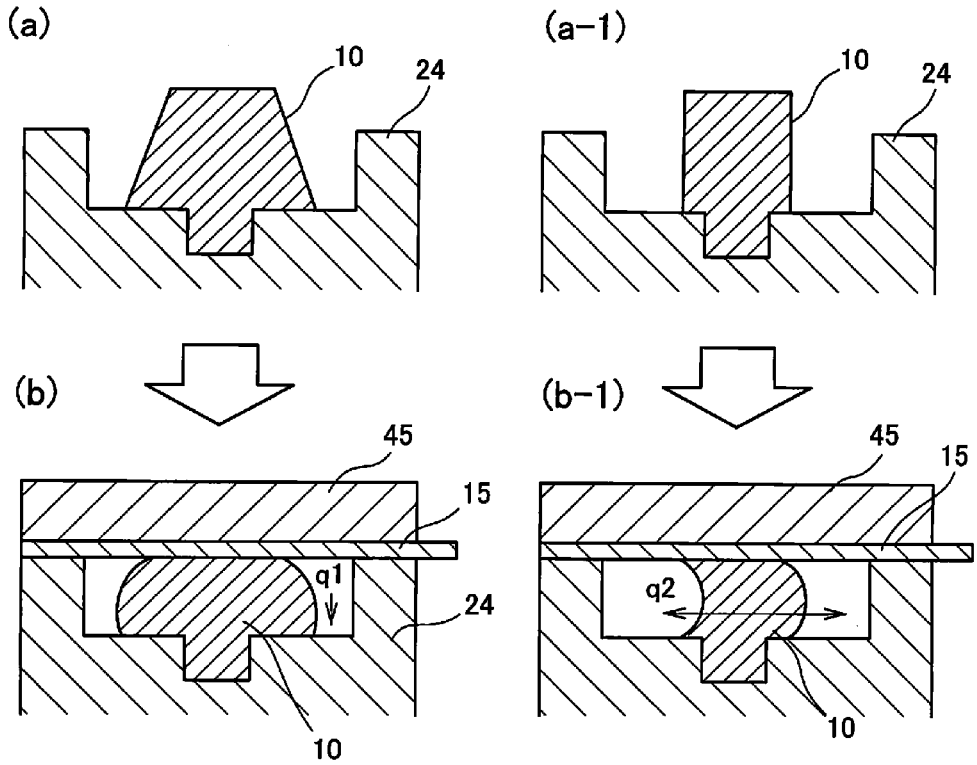

Parts (a), (b), (a-1) and (b-1) of FIG. 37 are schematic views for illustrating an effect of a molded shape of an elastomer member in Embodiment 3.

Figure 38:
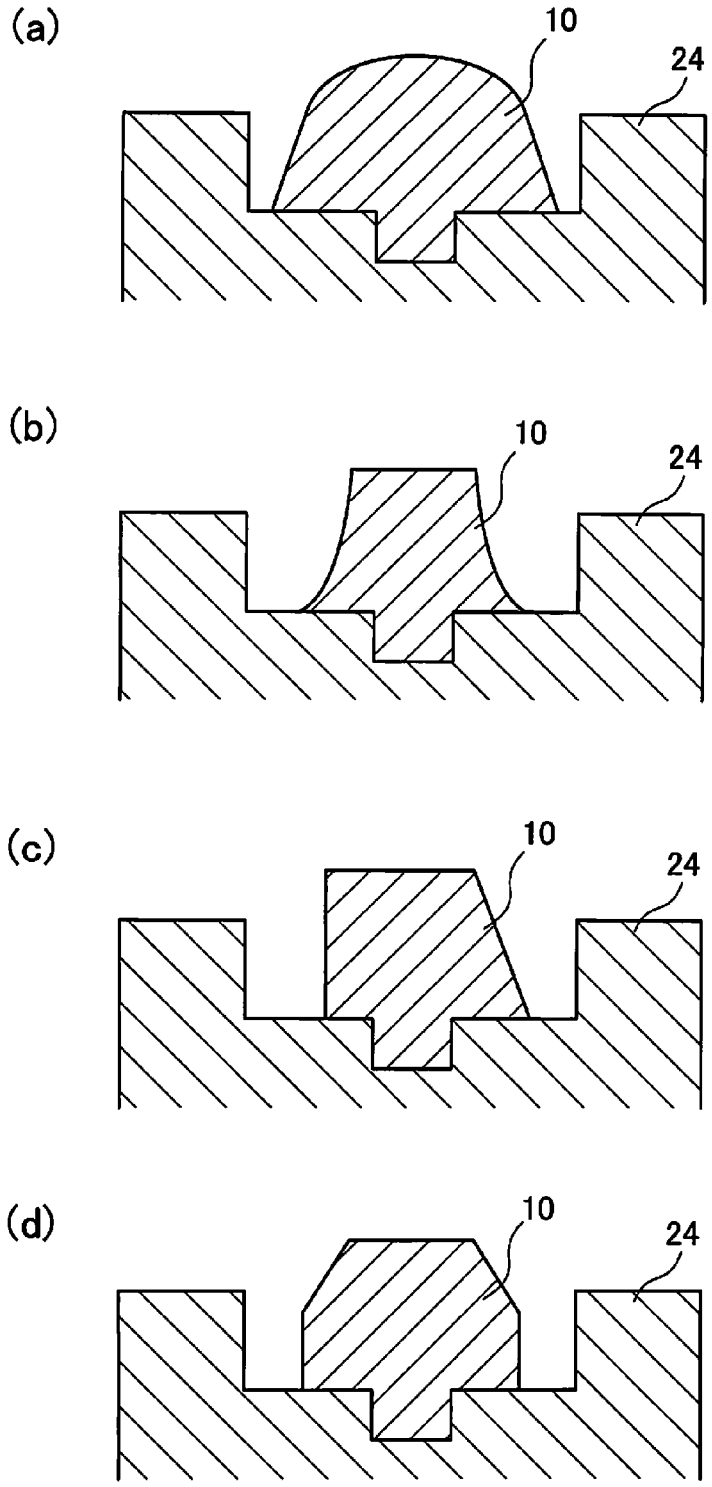

Parts (a) to (d) of FIG. 38 are schematic views each for illustrating an effect of a molded shape of an elastomer member in Embodiment 3.

Figure 39:
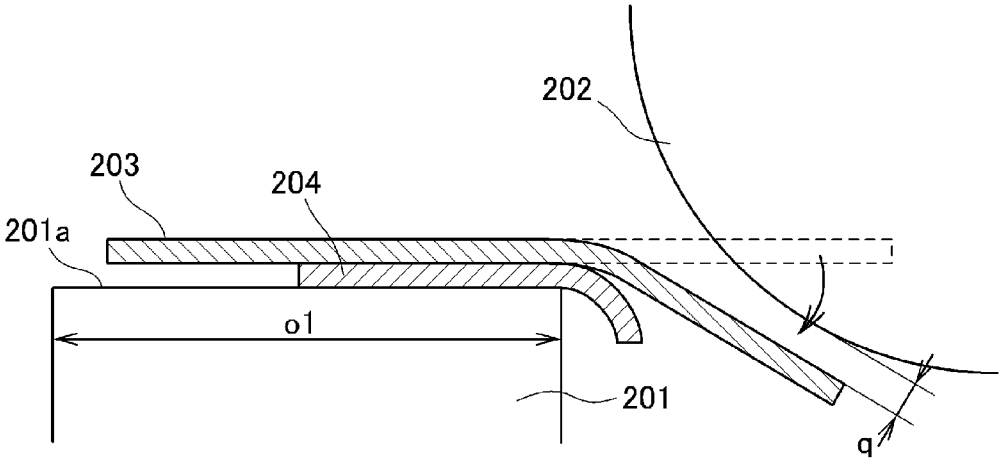

FIG. 39 is an illustration showing a state in which a sheet is inclined to generate a gap between the sheet and a developer carrying member.

DESCRIPTION OF THE PREFERRED EMBODIMENTS

Embodiment 1

Hereinbelow, embodiments for carrying out the present invention will be exemplarily and specifically described based on Embodiment 1 with reference to the drawings. However, dimensions, materials, shapes, relative arrangements and the like of constituent elements described in the following embodiments are appropriately changed depending on constitutions or various conditions of devices (apparatuses) to which the present invention is applied. That is, the scope of the present invention is not limited thereto.

In the following description, a longitudinal direction of a process cartridge is a direction (rotational axis direction of an image bearing member) crossing (substantially perpendicular to) a direction in which the process cartridge is mounted into an electrophotographic image forming apparatus main assembly. Left and right of the process cartridge are those as seen from the direction in which the process cartridge is mounted into the electrophotographic image forming apparatus main assembly.

An upper surface of the process cartridge is a surface located at an upper portion of the process cartridge in a state in which the process cartridge is mounted in the electrophotographic image forming apparatus main assembly, and a lower surface is a surface located at a lower portion of the process cartridge in the mounted state.

(Structure of Image Forming Apparatus Main Assembly)

Figure 1:
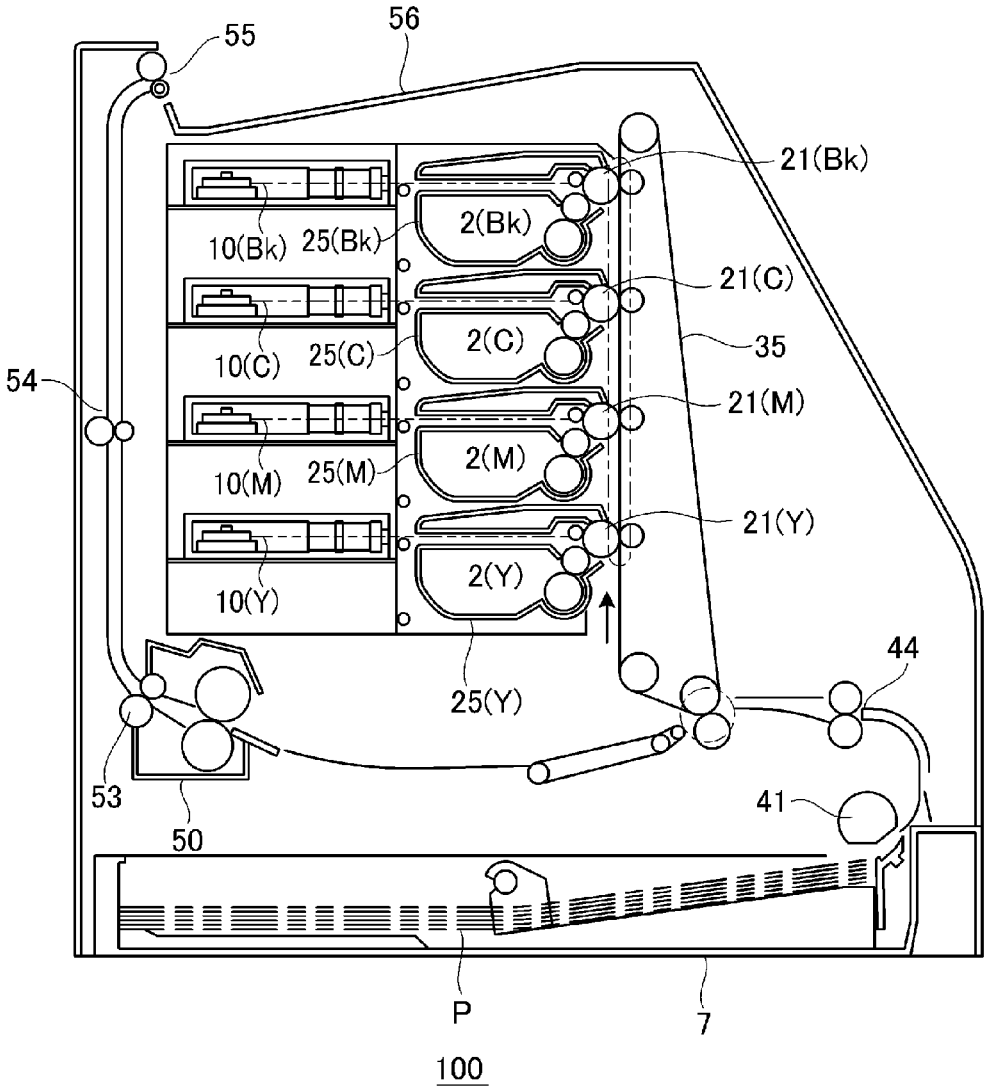
FIG. 1 is a schematic sectional view showing a general structure of an image forming apparatus in Embodiment 1.

A structure of a main assembly of the electrophotographic image forming apparatus in Embodiment 1 according to the present invention will be described with reference to FIG. 1. FIG. 1 is a schematic sectional view of a color laser beam printer as an example of the image forming apparatus (hereinafter referred to as an image forming apparatus main assembly). An image forming apparatus main assembly 100 includes process cartridges 2 for colors of Y (yellow), M (magenta), C (cyan) and Bk (black), an intermediary transfer belt (intermediary transfer member) 35, a fixing portion 50, a group of discharging rollers 53, 54 and 55, and a discharge tray 56. The process cartridges 2 for the four colors are independently constituted so as to be detachably mountable to the image forming apparatus main assembly 100.

Next, an operation of the image forming apparatus main assembly 100 will be described. First, a sheet feeding roller 41 is rotated to separate a sheet of a transfer material (recording material) P in a sheet feeding cassette 7 and then feeds the transfer material P to a registration roller 44. On the other hand, an image bearing members 21 and the intermediary transfer member 35 are rotated in an arrow direction in FIG. 1 at a predetermined outer peripheral speed V (hereinafter referred to as a process speed). A surface of the image bearing member 21 is electrically charged uniformly by the charging means and is subjected to exposure to light by a laser, so that an electrostatic latent image is formed. Simultaneously with this latent image formation, a developing unit 2*b* develops the latent image on the image bearing member 21 with a developer (toner). The color images of Y, M, C and Bk formed on the image bearing member 21 by development are primary-transferred onto an outer peripheral surface of the intermediary transfer member 35. The respective color images transferred onto the intermediary transfer member 35 are secondary-transferred onto the transfer material P and thereafter are fixed on the transfer material P. The transfer material P on which the images are fixed is discharged onto the discharge tray 56 via the discharge roller pairs 53, 54 and 55, so that the image forming operation is ended.

(Structure of Process Cartridge)

Figure 2:
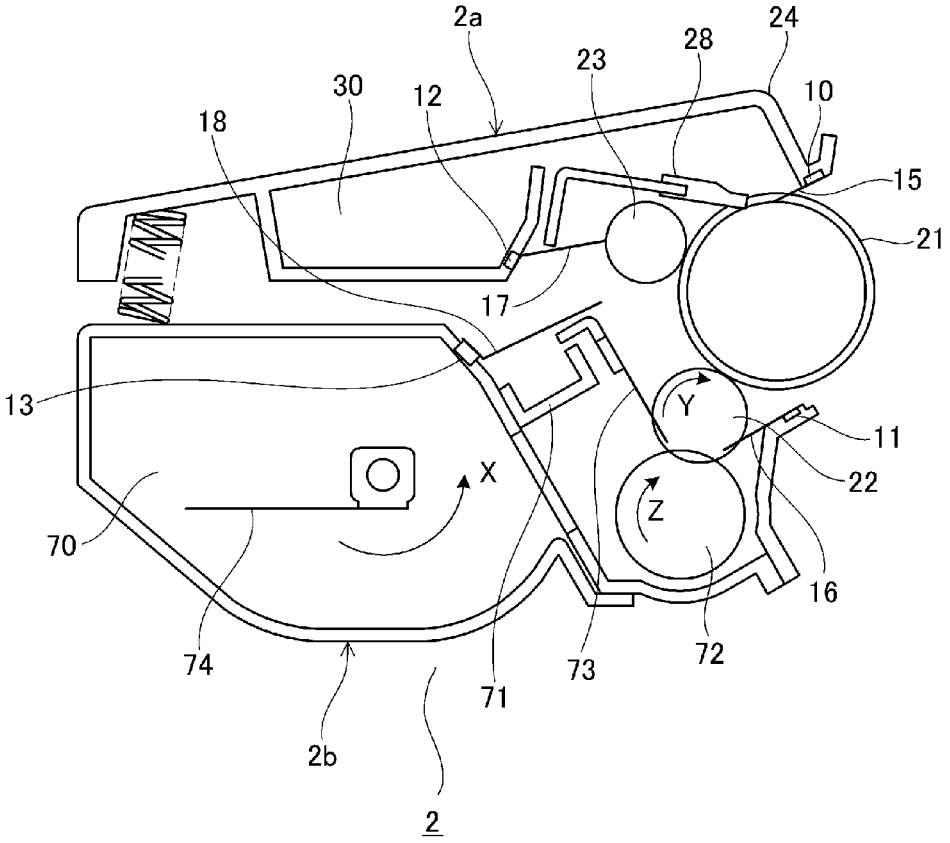
FIG. 2 is a schematic sectional view showing a process cartridge in Embodiment 1.

With reference to FIG. 2, a structure of the process cartridge 2 in this embodiment will be described. FIG. 2 is a schematic sectional view of the process cartridge 2. The process cartridges for Y, M, C and Bk have the same constitution. The process cartridge 2 is divided into a cleaning unit 2*a* and a developing unit 2*b*.

In the cleaning unit 2*a*, the image bearing member 21 as a rotatable member is rotatably mounted to a cleaning container 24. On a peripheral surface of the image bearing member 21, a charging roller 23 as a primary charging means for uniformly charging the surface of the image bearing member 21 and a cleaning blade 28 for removing the toner remaining on the image bearing member 21 are provided. Further, a receptor sheet (thin plate member) 15 as a flexible sheet member for scooping the toner removed by the cleaning blade 28 and an elastomer member (adhesive member) 10 as a resin member on which the receptor sheet 15 is fixed are provided. Further, a charging roller cleaner 17 for cleaning the charging roller 23 and an elastomer member 12 for fixing the charging roller cleaner 17 are provided.

The developing unit 25 is constituted by a developer carrying member 22 as a developing means, a toner container (developer accommodating portion) 70 accommodating the toner, and a developing container 71. The developer carrying member 22 is rotatably supported by the developing container 71. On a peripheral surface of the developer carrying member 22, a toner supplying roller 72 rotating an arrow Z direction in contact with the developer carrying member 22, a developer regulating member 73, a blowoff preventing sheet (thin plate member) 16, and an elastomer member (adhesive member) for fixing the blowoff preventing sheet 16 are provided. Further, in the toner container 70, a toner stirring mechanism 74 is provided.

Next, an operation of the process cartridge 2 will be described. First, the toner is fed to the toner supplying roller 72 by the toner stirring mechanism 74 rotating in an arrow X direction in FIG. 2. The toner supplying roller 72 supplies the toner to the developer carrying member 22 by rotating in the arrow z direction. The toner supplied onto the developer carrying member 22 reaches a position of the developer regulating member (developing blade unit) 73 by rotation of the developer carrying member 22 in an arrow Y direction. The developer regulating member 73 regulates the toner to impart a desired electric charge amount to the toner and to form a predetermined thin toner layer. The toner regulated by the developer regulating member 73 is fed to a developing portion where the image bearing member 21 and the developer carrying member 22 contact and is used for development on the image bearing member under application of a developing bias to the developer carrying member 22. The toner used for development on the image bearing member 21 is primary-transferred onto the intermediary transfer member 35 and thereafter a residual toner remaining on the image bearing member 21 is removed by a cleaning blade 28. The removed residual toner is stored in a residual toner chamber (developer accommodating portion) 30.

(Cleaning Unit)

Figure 3:
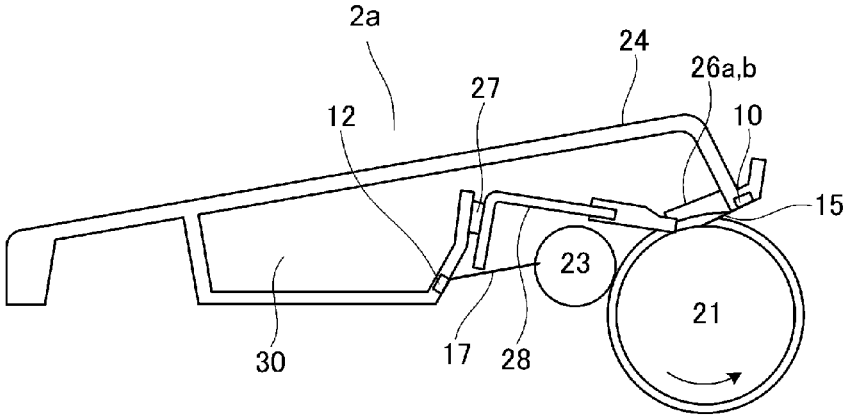
FIG. 3 is a schematic sectional view showing a cleaning member and an image bearing member in Embodiment 1.
Figure 4:
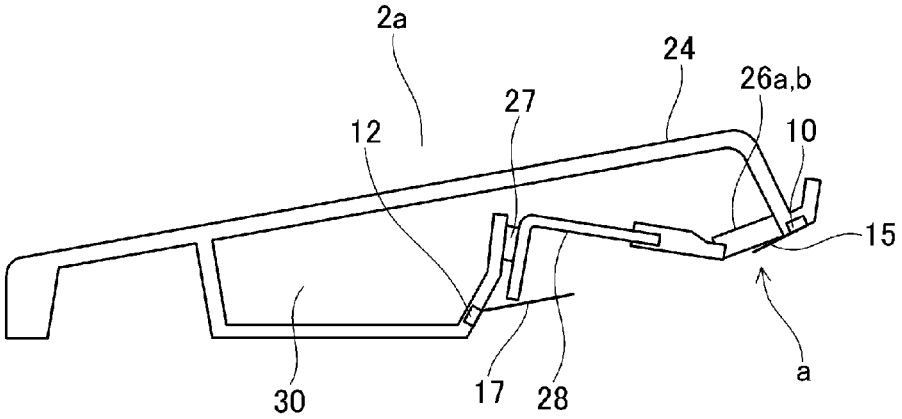
FIG. 4 is a schematic sectional view showing a structure of the cleaning member in Embodiment 1.
Figure 5:
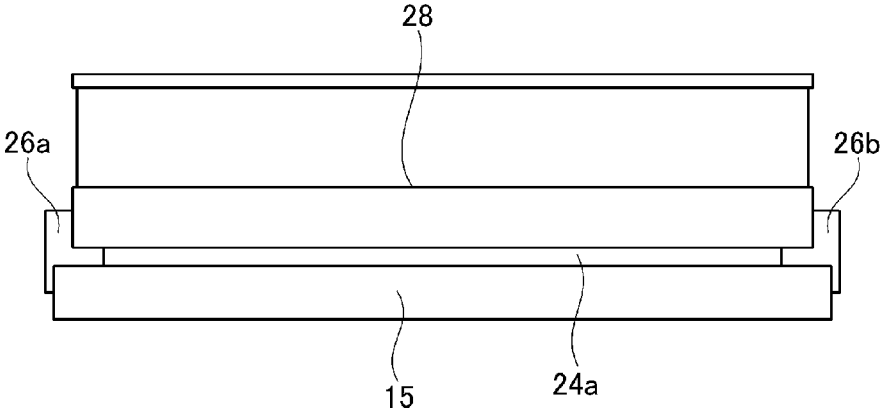
FIG. 5 is a structural illustration of the cleaning member in Embodiment 1 as seen from an arrow a direction shown in FIG. 4.

With reference to FIGS. 3 to 5, a structure of the cleaning unit 2*a* will be described. FIG. 3 is a schematic sectional view showing the cleaning member and the image bearing member 21, FIG. 4 is a schematic sectional view showing a structure of the cleaning member, and FIG. 5 is an illustration of the cleaning means as seen from an arrow a direction in FIG. 4.

As shown in FIGS. 3 and 4, the cleaning blade 28 for scraping off a residual matter such as the residual toner from the image bearing member 21, and the receptor sheet 15 for scooping the scraped residual toner are provided. Further, the residual toner chamber 30 for accommodating the residual matter, image bearing member end portion seal members 26*a* and 26*b*, provided at end portions of the cleaning blade 28 so as to prevent the residual matter from leaking out of the residual toner chamber 30, and an under-cleaning blade seal 27 are provided. These members are incorporated into an assembled with the cleaning container 24 to constitute the cleaning unit 2*a*.

Specifically, as shown in FIG. 5, the cleaning blade 28 and the receptor sheet 15 contact the outer peripheral surface of the image bearing member 21 at a position where they do not interfere with each other and where an opening 24*a* is formed. The receptor sheet 15 is welded on an elastomer member 10 portion formed by injection molding, as the adhesive member for the receptor sheet 15, on the cleaning container 24. This will be described later specifically. The image bearing member 21 is configured such that it is disposed at the opening 24*a* of the cleaning container 24, and the receptor sheet 15 is provided for preventing the toner from leaking out from a gap between the cleaning container 24 and the image bearing member 21 by the contact with the image bearing member 21. Further, the image bearing member end portion seal members 26*a* and 26*b* are disposed on the basis of the cleaning blade 28 as shown in FIG. 5 and are contacted to the receptor sheet 15 at end portions, and are also contacted to the outer peripheral surface of the image bearing member 21 as shown in FIG. 3. Further, by the under-cleaning blade seal 27, a gap between the cleaning blade 28 and the cleaning container 24 or the like gap is hermetically sealed.

Further, a charging roller cleaner 17 for cleaning the charging roller 23 is provided and welded on an elastomer member 12 portion molded, as an adhesive member for the charging roller cleaner 17, on the cleaning container 24.

(Developing Unit)

Figure 6:
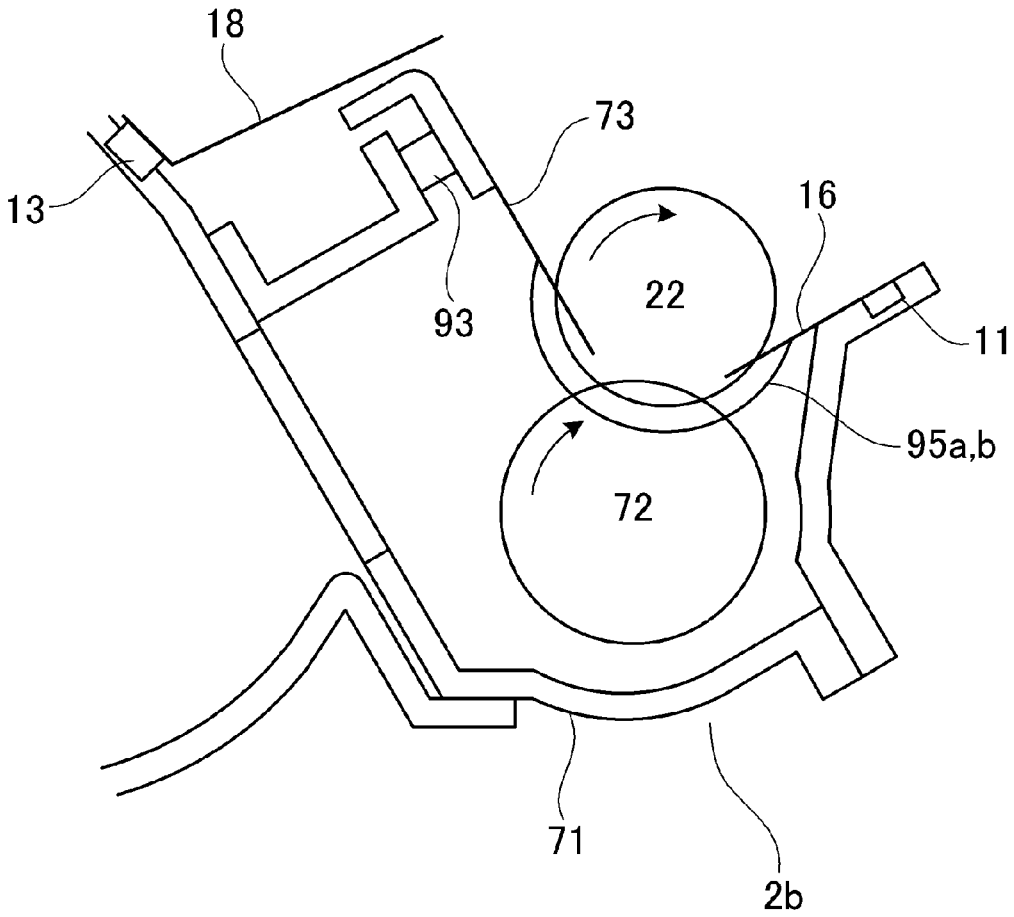
FIGS. 6 and 7 are schematic sectional views each showing constituent members of a developing unit in Embodiment 1.
Figure 7:
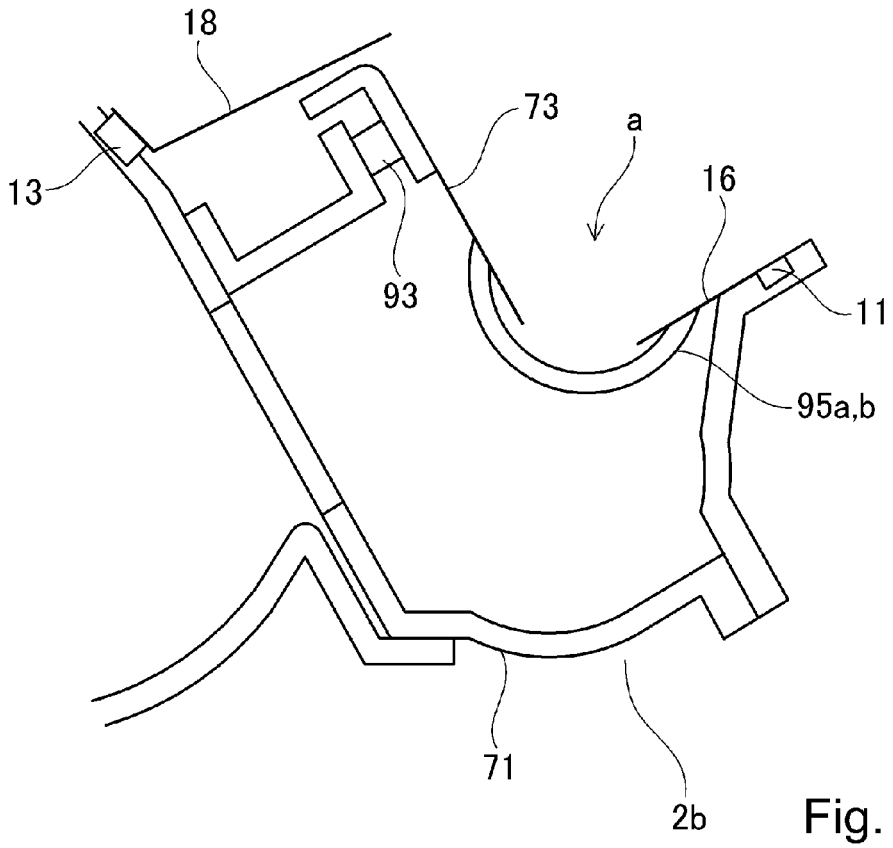
Figure 8:
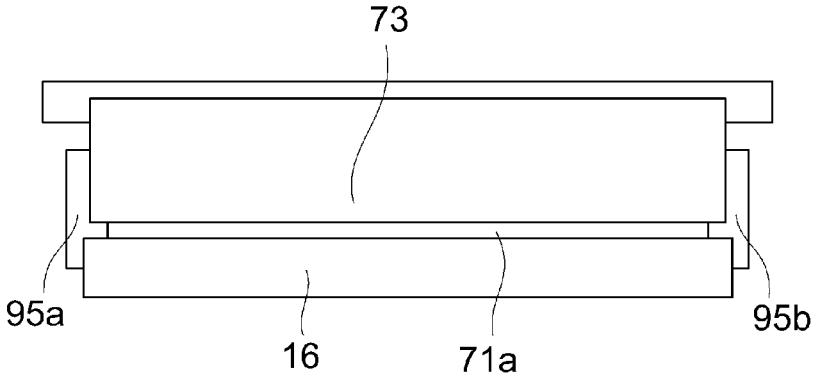
FIG. 8 is an illustration of the developing unit in Embodiment 1 as seen from an arrow a direction shown in FIG. 7.

With reference to FIGS. 6 to 8, a structure of the developing unit 2*b* will be described. FIG. 6 is a schematic sectional view showing the blowoff preventing sheet 16, the developing blade unit 73, developer carrying member end portion seal members 95*a* and 95*b*, and the developer carrying member 22. FIG. 7 is a schematic sectional view showing the blowoff preventing sheet 16, the developing blade unit 73, and the developer carrying member end portion seal members 95*a* and 95*b*. FIG. 8 is a schematic view of the these members as seen from an arrow a direction shown in FIG. 7.

As shown in FIGS. 6 and 7, the developing blade unit 73 for uniformizing the toner on the developer carrying member 22 and the blowoff preventing sheet 16 for preventing the toner from blowing off from a gap between the developer carrying member 22 and the developing container 71 are provided. Further, the developing container 71 for accommodating the toner, the developer carrying member end portion seal members 95*a* and 95*b* provided at end portions of the developing blade unit 73 so as to prevent the residual matter from leaking out of the process cartridge 71, and an under-developing blade seal 93 are provided. These members are incorporated into an assembled with the developing container 71 to constitute the developing unit 2*a*.

Specifically, as shown in FIG. 8, the developing blade unit 73 and the blowoff preventing sheet 16 contact the outer peripheral surface of the developer carrying member 22 at a position where they do not interfere with each other and where an opening 71*a* is formed. The blowoff preventing sheet 16 is welded on an elastomer member 11 portion molded, as the adhesive member for the blowoff preventing sheet 16, on the developing container 71. This will be described later specifically. Further, the developer carrying member end portion seal members 95*a* and 95*b* are, as shown in FIG. 8, contacted to the developing blade unit 73 and the blowoff preventing sheet 16 at end portions, and are also contacted to the outer peripheral surface of the developer carrying member 22 as shown in FIG. 6. Further, by the under-developing blade seal 93, a gap between the developing blade unit 73 and the developing container 71 or the like gap is hermetically sealed.

Further, a scattering preventing sheet 18 for preventing toner scattering is provided and welded on an elastomer member 13 portion molded, as an adhesive member for the scattering preventing sheet, on the developing container 71.

(Molding of Elastomer Member)

With reference to FIGS. 9 to 11, a molding process of the elastomer member 10 will be described. Parts (a) to (d) of FIG. 9 are schematic views for illustrating molding of the elastomer member 10 as the adhesive member, wherein (a) of FIG. 9 includes a schematic view of the cleaning container 24 and a schematic enlarged view of an injection port portion, (b) of FIG. 9 is a schematic view showing a state in which an elastomer molding metal mold 83 is clamped on the cleaning container 24, (c) of FIG. 9 is a schematic sectional view taken along A-A line indicated in (b) of FIG. 9, and (d) of FIG. 9 is a schematic sectional view taken along B-B line indicated in (b) of FIG. 9. FIG. 10 is a schematic sectional view taken along the A-A line indicated in (b) of FIG. 9 and shows a state of the elastomer member 10 during molding. FIG. 11 is a schematic view showing the state of the elastomer member during molding.

As shown in (a) to (d) of FIG. 9, an elastomer member-forming portion 71*d* is provided between the image bearing member end portion seal members 26*a* and 26*b* in an end side and another end side, respectively, of the cleaning container 24. The elastomer member-forming portion 71*d* includes a recessed portion 71*d*1 into which the elastomer member 10 is to be injected, and contact surfaces 71*d*2 and 71*d*3 to which the metal mold is to be contacted. Further, at a predetermined longitudinal position, a cylindrical injection port 76 which communicates with the recessed portion 71*d*1 of the seal (elastomer member forming portion 71*d* is provided.

Next, a molding method of the elastomer member 10 will be described. In this embodiment, as shown in (a) of FIG. 9, the injection port 76 is provided at one longitudinal central portion of the elastomer member-forming portion 71*d* but may also be provided at two positions or more. When the elastomer member 10 is molded, as shown in (c) and (d) of FIG. 9, the elastomer molding metal mold 83 is contacted to the contact surfaces 71*d*2 and 71*d*3 of the elastomer member-forming portion 71*d* of the cleaning container 24. The elastomer molding metal mold 83 is configured to be cut into a shape of the elastomer member 10, i.e., is provided with a recessed portion 83*d* having a shape corresponding to an outer shape of the elastomer member 10. Then, a gate 82 of a resin material injection device is contacted to the injection port 76 provided at the one longitudinal central portion of the cleaning container 24. Then, a thermoplastic elastomer (resin material) for constituting the elastomer member 10 is injected from the gate 82 of the resin material injection device into the injection port 76 of the cleaning container 24 as indicated by an arrow in (c) of FIG. 9. The injected thermoplastic elastomer is caused to flow into a molding space formed, as shown in FIG. 10, by the recessed portion 71*d*1 of the elastomer member-forming portion 71*d* of the cleaning container 24 and the recessed portion 83*d* of the elastomer molding metal mold 83. The thermoplastic elastomer injected from the one longitudinal central portion flows, as shown in FIG. 11, in the molding space formed by the recessed portion 71*d*1 of the elastomer member-forming portion 71*d* and the recessed portion 83*d* of the elastomer molding metal mold 83, toward longitudinal end sides. Thus, the thermoplastic elastomer is injected and molded in the molding space formed by bringing the mold into contact with the cleaning container 24, so that the elastomer member 10 is molded integrally with the cleaning container 24.

The elastomer member 10 is integrally molded with the cleaning container 24. In this embodiment, as the material for the elastomer member 10, a styrene-based elastomer resin material is used. This is because the cleaning container 24 is formed of high-impact polystyrene (HI-PS) and therefore as the elastomer resin material, the styrene-based elastomer resin material which is the same type material as HI-PS and has elasticity is preferred. When parts of the same type resin materials are used, the parts are not required to be disassembled from each other and therefore the parts are excellent in disassembling operativity during recycling of the process cartridge. Incidentally, an elastomer resin toner other than the above-described elastomer resin material may also be used so long as it has a similar mechanical characteristic.

In this embodiment, as the elastomer member 10 to be formed by the molding, an elastomer member having a physical property of 2.5 MPa to 10 MPa in elastic modulus is used. Adjustment of the elastic modulus was effected by incorporating 20 wt. parts of polyethylene (PE) into 100 wt. parts of the styrene-based elastomer resin material. However, the elastomer resin material may only be required to provide the resultant elastomer member with the elastic modulus of 2.5 MPa to 10 MPa, and therefore the content of PE may be changed and a resin material other than PE may also be used. It is also possible to use other elastomer resin materials.

The above-described molding method of the elastomer member 10 with the cleaning container 24 may also be applicable to molding of the elastomer members 11 and 13 with the developing container 71 and molding of the elastomer member 21 with the cleaning container 24. Incidentally, as the molding method of the elastomer members 10, 11, 12 and 13, in addition to the above-described molding method, it is also possible to effect the molding on the frame such as the cleaning container 24, the developing container 71 or the like by two-color molding, insert molding or the like.

In the case of a conventional method using a double-side tape as the adhesive member, the double-side tape is soft and therefore it is more difficult to apply the double-side tape onto the frame with a narrower width of the double-side tape. However, in Embodiment 1, the elastomer resin material is directly molded into the elastomer member with the frame by using the mold, so that the elastomer member can be formed on the frame with a higher degree of accuracy than that of the double-side tape. Further, in the case of the conventional method using the double-side tape as the adhesive member, after the resultant structure is left standing in a high temperature environment, deviation is generated at a bonded interface between the double-side tape and the frame. However, in Embodiment 1, the elastomer member is directly formed on the frame by molding, so that it is possible to suppress deviation at a bonded interface between the elastomer member and the frame.

(Molded Shape of Elastomer Member on Container)

With reference to FIGS. 12 to 17, various structural examples of molded shapes of the elastomer members 10, 11, 12 and 13 integrally molded with the frame (such as the cleaning container 24 or the developing container 71) and the elastomer member-forming portion on the frame will be described.

Figure 12:
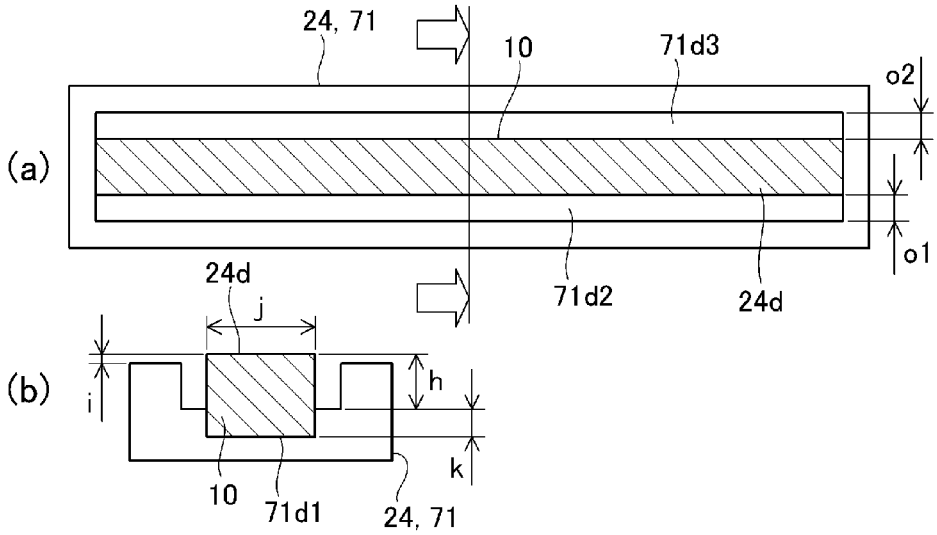
Figure 13:
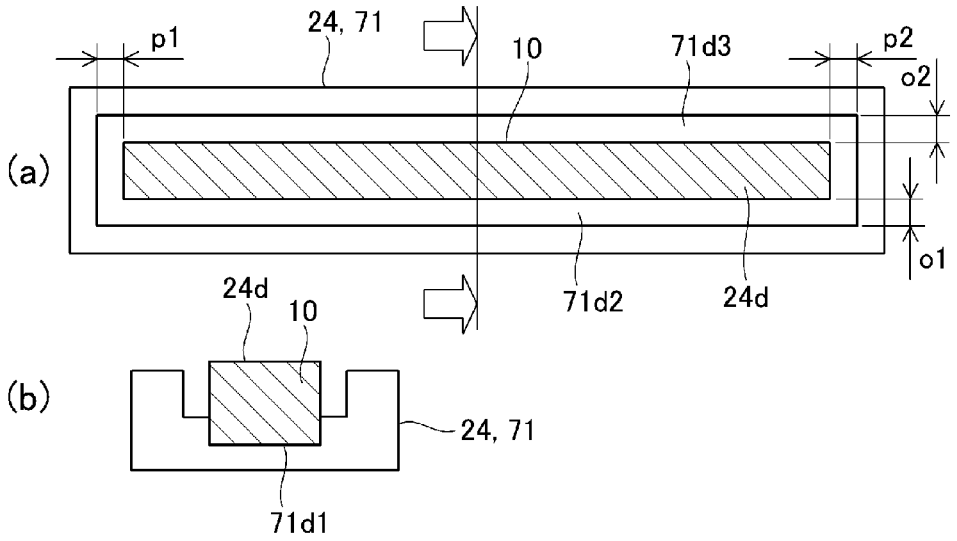
Figure 14:
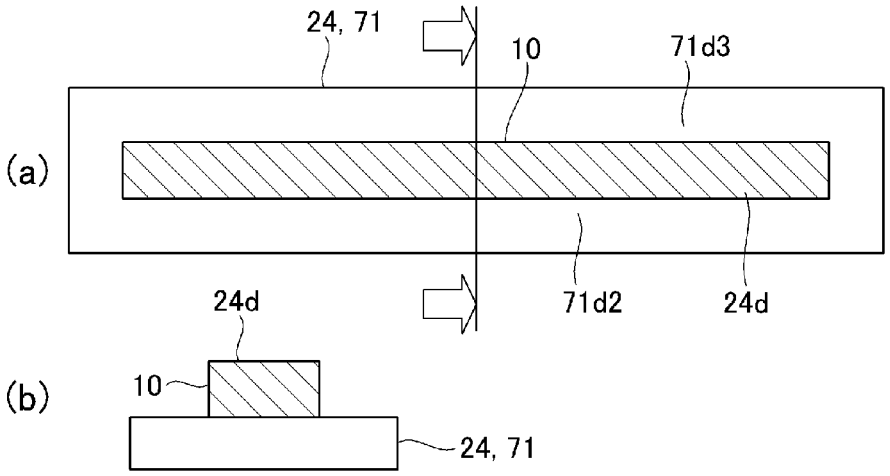
Figure 15:
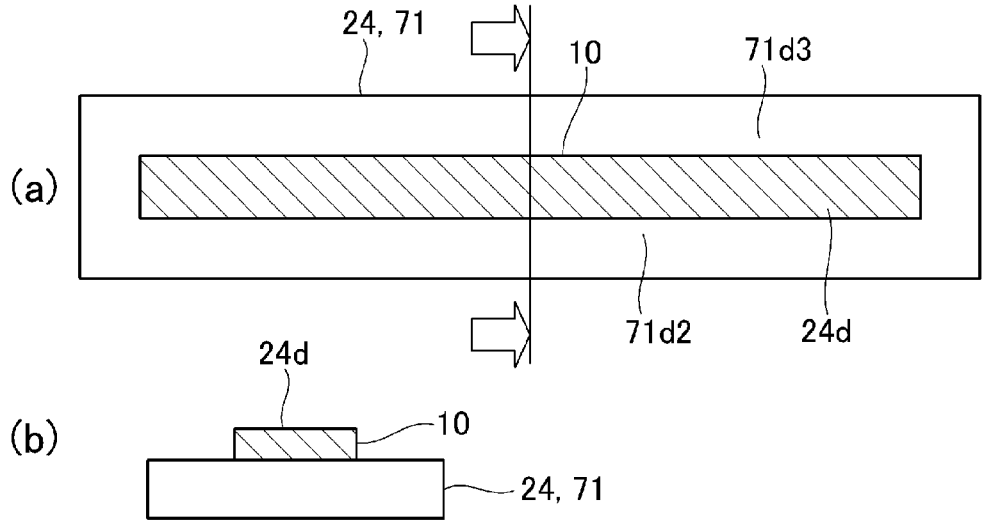
Figure 16:
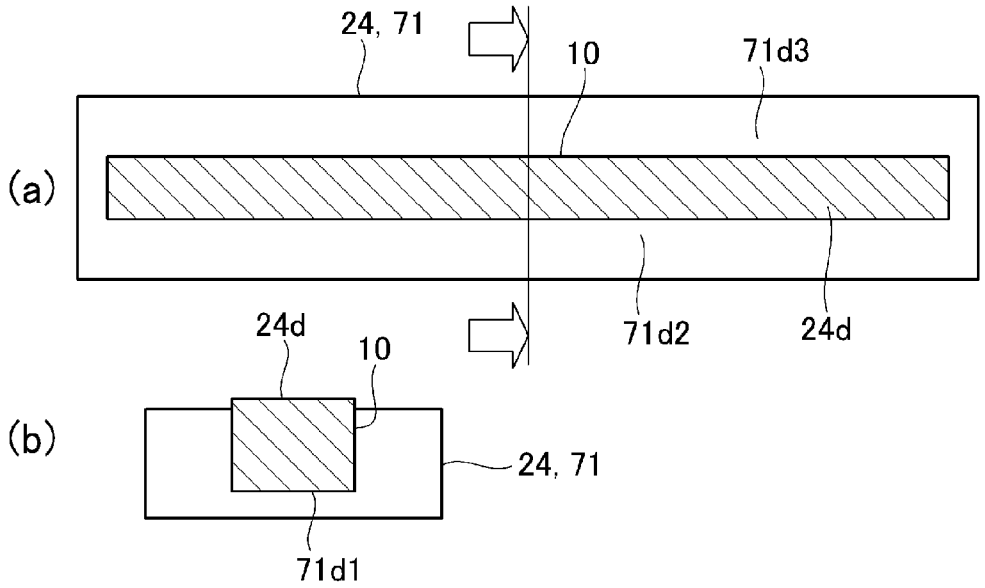
Figure 17:
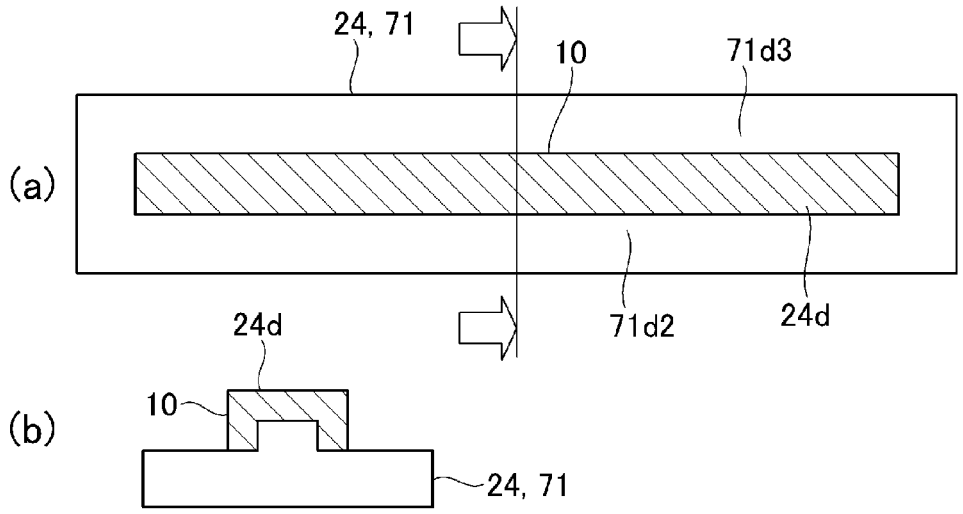

Parts (a) and (b) of FIG. 12 are schematic views for illustrating a molded shape 1 of the elastomer member 10, in which (a) of FIG. 12 is a schematic front view showing the elastomer member 10 and a part of the frame, and (b) of FIG. 12 is a schematic sectional view taken along a line indicated by arrows in (a) of FIG. 12. Parts (a) and (b) of FIG. 13 are schematic views for illustrating a molded shape 2 of the elastomer member 10, in which (a) of FIG. 13 is a schematic front view showing the elastomer member 10 and a part of the frame, and (b) of FIG. 13 is a schematic sectional view taken along a line indicated by arrows in (a) of FIG. 13. Parts (a) and (b) of FIG. 14 are schematic views for illustrating a molded shape 4 of the elastomer member 10, in which (a) of FIG. 14 is a schematic front view showing the elastomer member 10 and a part of the frame, and (b) of FIG. 14 is a schematic sectional view taken along a line indicated by arrows in (a) of FIG. 14. Parts (a) and (b) of FIG. 15 are schematic views for illustrating a molded shape 2 of the elastomer member 10, in which (a) of FIG. 15 is a schematic front view showing the elastomer member 10 and a part of the frame, and (b) of FIG. 15 is a schematic sectional view taken along a line indicated by arrows in (a) of FIG. 15. Parts (a) and (b) of FIG. 16 are schematic views for illustrating a molded shape 5 of the elastomer member 10, in which (a) of FIG. 16 is a schematic front view showing the elastomer member 10 and a part of the frame, and (b) of FIG. 16 is a schematic sectional view taken along a line indicated by arrows in (a) of FIG. 16. Parts (a) and (b) of FIG. 17 are schematic views for illustrating a molded shape 6 of the elastomer member 10, in which (a) of FIG. 17 is a schematic front view showing the elastomer member 10 and a part of the frame, and (b) of FIG. 17 is a schematic sectional view taken along a line indicated by arrows in (a) of FIG. 17.

As show in (a) and (b) of FIG. 12, in the molded shape 1, the elastomer member 10 formed by molding at the recessed portion as the elastomer member-forming portion 71*d*1 of the frame is in non-contact with the frame with widths o1 and o2, which are larger than 0 mm, with respect to an entire widthwise region except for longitudinal end portions. That is, a regulating portion capable of regulating a position of the sheet member of the frame is provided with spacings o1 and o2 from the elastomer member 10 with respect to the widthwise direction of the elastomer member 10.

Further, as shown in (b) of FIG. 12, the elastomer resin material is molded while ensuring a free length (height) h of 0.5 mm or more and entering the frame with a depth k of 0.3 mm during the molding into the elastomer member 10. That is, the elastomer resin material is injected and molded so that a part of the elastomer member 10 enters the recessed portion of the frame. This is because a sheet welding portion of the elastomer member 10 is prevented from being influenced by elongation due to linear expansion of the frame under left-standing in the high temperature environment and also because the elastomer member 10 is fixed on the frame. Further, a height of a sheet member mounting surface (contact position) 24 before welding of the elastomer member 10 is made higher than a height of a contact surface (contact position) of the frame to be contacted with the sheet member of the sheet member regulating portion, by an elastomer member melting margin i.

The molded shape of the elastomer member 10 in this embodiment may only be required to possess the following features (1) to (3).

(1) The sheet member mounting surface 24*d* of the elastomer member 10 is not influenced by the elongation due to linear expansion of the frame under left-standing in the high temperature environment.

(2) The elastomer member 10 functions as a buffer layer which prevents the sheet member (thin plate member) such as the receptor sheet 15 from being influenced by the linear expansion of the frame.

(3) The elastomer member 10 is not easily detached from the frame.

When the above three features (1) to (3) are satisfied, as shown in (a) and (b) of FIG. 13, a constitution (molded shape 2) in which the elastomer member 10 is in non-contact with the frame in entire longitudinal and widthwise regions with widths p1 and p2 which are larger than 0 mm and with widths o1 and o2 which are larger than 0 mm may also be employed. Further, when the elastomer member 10 has an adhesive property, as shown in (a) and (b) of FIG. 14, a constitution (molded shape 3) in which the frame is not provided with the recessed portion but the elastomer member 10 is formed in a projected shape on the flat surface of the frame may also be employed. Further, in the case where a sufficiently flexible elastomer member 10 is formed by molding, as shown in (a) and (b) of FIG. 15, a constitution (molded shape 4) in which the free length (height) from the frame is made smaller than that of the molded shape 1 may also be employed. Further, as shown in (a) and (b) FIG. 16, a constitution (molded shape 5) in which the depth of the elastomer member-forming portion 71*d*1 is made deeper than that of the molded shape 1 while making the free length from the frame smaller than that of the molded shape 1 may also be employed. Further, as shown in (a) and (b) of FIG. 17, a constitution (molded shape 6) in which the elastomer member 10 is formed by molding so as to cover a projected portion provided on the frame may also be employed.

The above-described various structural examples of the molded shapes of the elastomer member 10 with the cleaning container 24 are also applicable to molded shapes of the elastomer members 11 and 13 with the developing container 71 and molded shapes of the elastomer member 12 with the cleaning container 24.

In the case of the conventional method using the double-side tape as the adhesive member, the double-side tape functions as a buffer material for absorbing a difference in linear expansion, under left-standing in the high temperature environment, between the frame and the sheet member, so that waving of the sheet member after being left standing in the high temperature environment can be prevented. Therefore, also in Embodiment 1, by forming the elastomer member 10 on the frame by molding, the elastomer member 10 can function as the buffer material for absorbing the difference in linear expansion, under left-standing in the high temperature environment, between the frame and the sheet member. By this effect, it becomes possible to prevent waving of the sheet member after being left standing in the high temperature environment.

(Sheet Welding)

With reference to FIGS. 18 to 24, a sheet welding step in this embodiment of the present invention will be described by taking the case where a semiconductor laser is used, as an example.

Parts (a) and (b) of FIG. 18 are schematic illustrations of the cleaning container on which the receptor sheet 15 is mounted, in which (a) of FIG. 18 shows a state in which waving of the receptor sheet 15 is not generated, and (b) of FIG. 18 shows a state in which waving of the receptor sheet 15 is generated. Parts (a) and (b) of FIG. 19 are schematic views for illustrating a method of imparting tension to an upper edge of the receptor sheet, in which (a) of FIG. 19 shows a state in which the sheet member mounting surface 24*d* of the cleaning container 24 is curved by a tension (pulling) jig 48, and (b) of FIG. 19 shows a state in which the tension is imparted to the upper edge of the receptor sheet 15 by relieving the curve of the sheet member mounting surface 24*d* of the cleaning container 24. FIG. 20 is a schematic view for illustrating a state in which the elastomer member 10 formed on the cleaning container 24 by molding is melted to weld the receptor sheet 15. FIG. 21 is a schematic sectional view showing the state of FIG. 20. FIG. 22 is a partially enlarged view of portion D shown in FIG. 21. FIG. 23 is a schematic view for illustrating the cleaning container 24 on which the receptor sheet 15 is welded on the elastomer member 10. Parts (a) and (b) of FIG. 24 are schematic view showing a molded shape of the elastomer member in Embodiment 1, in which (a) of FIG. 24 is a schematic front view of the molded shape, and (b) of FIG. 24 is a schematic sectional view of the molded shape.

In this embodiment, the receptor sheet 15 formed of polyester with a thickness of 38 μm and a light transmittance of 85% (near infrared ray of 960 nm) was used. First, as shown in (a) of FIG. 18, the cleaning container 24 is prepared. In this case, as shown in (b) of FIG. 18, waving x can occur at an edge (contact portion with the image bearing member 21) of the receptor sheet 15 due to creases of the receptor sheet 15 itself, an environmental fluctuation, and the like. For this reason, when the receptor sheet 15 is mounted, as shown in (a) of FIG. 19, a force-receiving portion (for receiving a force when the sheet member mounting surface 24*d* is curved) of the sheet member mounting surface 24*d* of the cleaning container 24 is pulled downward by the tension jig 48. By elastic deformation at this time, the sheet member mounting surface 24*d* is curved, and the receptor sheet 15 is mounted in this state and thereafter the curve is released. In this way, by curving the cleaning container 14, an initial tension amount n is provided to the edge of the receptor sheet 15 as shown in (b) of FIG. 19, so that waving is prevented. In this embodiment, the initial tension amount n is provided in a range of 0.5 mm to 0.8 mm.

As shown in FIGS. 20 to 22, in this embodiment, in a state in which a lower portion of the sheet member mounting surface 24*d* of the elastomer member 10 formed on the cleaning container 24 by molding is curved by using the tension jig 48, the receptor sheet 15 is superposed on the sheet member mounting surface 24*d* so as to be contacted to the sheet member mounting surface 24*d*. Further, the receptor sheet 15 is press-contacted to a sheet position regulating surface 49 by using an urging jig 45, which is transparent to near infrared ray, from above the receptor sheet 15. As a result, the receptor sheet 15 is temporarily positioned so that a position of the receptor sheet 15 relative to the cleaning container 24 is not shifted (deviated) during bonding of the receptor sheet 15.

Thereafter, laser light e of near infrared ray is emitted from a laser irradiation head 60, via the receptor sheet 15, toward the sheet member mounting surface 24*d* of the elastomer member 10 formed on the cleaning container 24 by molding. The elastomer member 10 contains carbon black so as to absorb near infrared ray. For this reason, the emitted laser light e passes through the urging jig 45 and the receptor sheet 15 which are transparent to near infrared ray, and is absorbed by the sheet member mounting surface 24*d* of the elastomer member 10 formed on the cleaning container 24 by molding. The laser light absorbed by the sheet member mounting surface 24*d* is conversed into heat and thus the sheet member mounting surface 24*d* generates heat, so that the elastomer member 10 is melted by the heat and thus can be welded with (bonded to) the receptor sheet 15 contacting the sheet member mounting surface 24*d*.

Here, the laser light e emitted from the irradiation head 60 was focused to a circular spot of 1.5 mm in diameter when it reaches the sheet member mounting surface 24*d*. That is a spot diameter of the laser light is 1.5 mm. Further, by making a molding width of the elastomer member smaller than 1.5 mm, it becomes possible to uniformly melt the sheet member mounting surface 24*d* of the elastomer member 10. Therefore, in this embodiment, a melting width e1 of the elastomer member 10 is about 1.0 mm. Further, the receptor sheet 15 is irradiated with the laser light continuously from its end portion to its another end portion. As a result, a welded surface g1 continuously extending in the longitudinal direction as shown in FIG. 23 can be obtained.

Further, as the urging jig 45, a member having a rigidity such that it can press an entire contact surface between the receptor sheet 15 and the sheet member mounting surface 24*d* of the elastomer member 10 formed on the cleaning container 24 by molding may preferably be used. Specifically, acrylic resin, glass and the like may preferably be used.

Further, the cleaning container 24 on which the elastomer member 10 having the sheet member mounting surface 24*d* is formed by molding is formed of the resin material, so that when the receptor sheet 15 is mounted, the sheet member mounting surface 24*d* is curved to cause some unevenness or deformation in some cases. Further, in some cases, the position of the receptor sheet 15 relative to the cleaning container 24 is shifted. Therefore, in this embodiment, the urging jig 45 was provided with an elastic urging member 47. By the urging member 47, the receptor sheet 15 is elastically urged toward the cleaning container 24 to be temporarily positioned, so that an adhesive property between the receptor sheet 15 and the sheet member mounting surface 24*d* can be improved. Further, positional deviation of the receptor sheet 15 can be prevented. Specifically, as the urging jig 45, a member including an acrylic member 46 as a rigid member and a 5 mm-thick silicone rubber member (urging member) 47 as an elastic member which are bonded with a transparent double-side tape was used. Incidentally, after the receptor sheet 15 is welded on the elastomer member 10 and then the urging jig 45 is removed, the deformation of the elastomer member 10 is eliminated, so that the receptor sheet 15 is spaced from the surface 49.

Further, as a near infrared ray irradiation device, a device ("FD200" (wavelength: 960 nm), mfd. by FINE DEVICE Co., Ltd.) was used. A longitudinal scanning speed of the near infrared ray irradiation device was 50 mm/sec, an output was 20 W, and a spot diameter on the elastomer member surface was 1.5 mm. Further, an energy density at the surface of the elastomer member 10 was 0.22 J/mm$^2$. Further, as the elastomer member 10, a member prepared by incorporating 0.5 to 12.0 wt. parts of carbon black into 100 wt. parts of the styrene-based elastomer resin material was used.

The above-described bonding method between the receptor sheet 15 and the elastomer member 10 formed on the cleaning container 24 by molding can also be applied to welding between the blow off preventing sheet 16 and the elastomer member 11 formed on the developing container 71 by molding. Similarly, the bonding method is also applicable to bonding between the charging roller cleaner 17 and the elastomer member 12 formed on the cleaning container 24 by molding. Further, the bonding method is also applicable to welding between the scattering preventing sheet 18 and the elastomer member 13 formed on the developing container 71 by molding. Further, in this embodiment, the receptor sheet 15 having the light transmittance of 85% or less may also be weldable. Further, as a method other than the welding (bonding) method in this embodiment, the elastomer member 10 and the receptor sheet 15 may also be welded by heat seal or the like. Incidentally, by the heat seal or the like, heat cannot be applied to only a bonded interface between the receptor sheet 15 and the elastomer member 10 but is conducted (applied) from an upper surface of the receptor sheet 15. Therefore, there is also a need to take a heat conduction time and melting of the receptor sheet 15 into consideration.

In the case of the conventional method using the double-side tape as the adhesive member, after left-standing in the high temperature environment, deviation is generated at the bonded interface between the double-side tape and each of the sheet members such as the receptor sheet 15, so that the initial tension of the sheet member is attenuated. In this embodiment, the sheet member and each of the elastomer members 10 to 13 are bonded by the welding. Further, by making an elastic modulus of the elastomer member smaller than that of the frame such as the cleaning container 24 or the developing container 71, an amount of permanent deformation of the elastomer member after being left standing in the high temperature environment can be made small. Further, after the left-standing in the high temperature environment, deviations at a bonded interface between the sheet member and the elastomer member and at a bonded interface between the frame and the elastomer member are not generated and therefore the initial tension of the sheet member can be maintained.

The elastomer member formed on the frame by molding in this embodiment specifically has a shape as shown in FIG. 24 such that dimensions thereof are h=0.6 to 0.8 mm, i=0.1 to 0.3 mm, j=1.0 mm, k=0.3 mm and r=1.6 mm. Here, h is a free length of the elastomer member during molding, i is an elastomer member melting margin, j is an elastomer member molding width (upper side), k is an entering amount of the elastomer member entering the container, and r is an elastomer member molding width (bottom side). In such a dimensional constitution, a section modulus is about 0.25. Further, the material for forming the frame is HIPS (high-impact polystyrene) and its linear expansion coefficient is 0.000087 (1/° C.), and an elastic modulus of the material is 2.38 GPa. The material for the sheet member is polyester and is 38 μm in thickness, 0.000015 (1/° C.) in linear expansion coefficient and 4.5 GPa in elastic modulus. That is, a degree of temperature change of the frame is about 5.8 times that of the sheet member. Therefore, when a left-standing environment is changed from normal temperature (e.g., 23° C.) to 50° C., a load corresponding to a difference in elongation between the frame and the sheet member is applied to the elastomer member sandwiched between the frame and the sheet member. This load is a difference in displacement between the frame and the sheet member in the 50° C. environment. In the case where the displacement under the 50° C. environment is calculated, the elongation amount of the frame (having a full length of 220 mm equal to that of the sheet member) is 0.52 mm and the elongation amount of the sheet member is 0.09 mm, so that the elongation difference Δ is 0.43 mm.

As described above, by making the elastic modulus of the elastomer member being a range, of 2.5 MPa or more and 10 MPa or less, which is smaller than the elastic modulus of the sheet member, it is possible to decrease the amount of permanent deformation of the elastomer member, due to the load under the 50° C. environment, at the time when the ambient temperature is restored to normal temperature. Further, each of the bonded interface between the frame and the elastomer member and the bonded interface between the sheet member and the elastomer member is formed by molding and welding and therefore no deviation is generated, so that the initial tension of the sheet member can be maintained. As a result, it becomes possible to prevent the waving of the sheet member.

As described above, according to Embodiment 1, the elastomer member is directly formed on the frame by molding and therefore it is possible to effect assembling with a higher degree of accuracy than that in the case of the double-side tape. Further, the deviation of the bonded interface, generated in the case of using the double-side tape, between the frame and the double-side tape after being left standing in the high temperature environment can be eliminated. Further, by bonding the sheet member and the elastomer member to each other by welding, it is possible to eliminate the deviation of the bonded interface, generated in the case of using the double-side tape as the adhesive member, between the sheet member and the double-side tape after being left standing in the high temperature environment. Further, by making the elastic modulus of the elastomer member smaller than the elastic modulus of the frame or the sheet member, the amount of permanent deformation of the elastomer member after being left standing in the high temperature environment can be made small. Further, there are no deviations of the bonded interface between the frame and the elastomer member and the bonded interface between the sheet member and the elastomer member, and therefore the initial tension of the sheet member can be maintained, so that the waving of the sheet member can be prevented.

Embodiment 2

Next, Embodiment 2 of the present invention will be described. Members or portions common to Embodiments 1 and 2 will be omitted from description.

The elastomer member formed on the frame by molding in this embodiment specifically has a shape as shown in FIG. 24 such that dimensions thereof are h=0.6 to 0.8 mm, i=0.1 to 0.3 mm, j=1.0 mm, k=0.3 mm, r=1.6 mm, and (p1, p2)=0.75 to 1.05 mm. Here, h is a free length of the elastomer member during molding, i is an elastomer member melting margin, j is an elastomer member molding width (upper side), k is an entering amount of the elastomer member entering the container, and r is an elastomer member molding width (bottom side).

The above-described various structural examples of the molded shape of the elastomer member 10 on the cleaning container 24 are also applicable to the molded shapes of the elastomer members 11 and 13 on the developing container 71 and the molded shape of the elastomer member 12 on the cleaning container 24.

(Sheet Welding)

With reference to FIGS. 29 to 34, a sheet member welding process in this embodiment of the present invention will be described by taking the case of using laser welding, as an example. Parts (a) and (b) of FIG. 29 are schematic illustrations of the cleaning container on which the receptor sheet 15 is mounted, in which (a) of FIG. 29 shows a state in which waving of the receptor sheet 15 is not generated, and (b) of FIG. 29 shows a state in which waving of a widthwise edge 15*a* of the receptor sheet 15 is generated. Parts (a) and (b) of FIG. 30 are schematic views for illustrating a method of imparting tension to an upper edge of the receptor sheet, in which (a) of FIG. 30 shows a state in which the receptor sheet 15 is placed on the sheet member mounting surface 24*d* of the cleaning container 24 under tension. The tension is generated by holding the receptor sheet 15 at two longitudinal end portions 15*c* and 15*d* in an upper edge 15*a* side and then by pulling the receptor sheet 15 in arrow L1 and L2 directions. Further, (b) of FIG. 30 shows a state in which the tension is imparted to the upper edge 15*a* of the receptor sheet 15. FIG. 31 is a schematic view for illustrating a state in which the elastomer member 10 formed on the cleaning container 24 by molding is melted to weld another (lower) edge 15*b* of the receptor sheet 15. FIG. 32 is a schematic sectional view showing the state of FIG. 31. FIG. 33 is a partially enlarged view of portion D shown in FIG. 32. FIG. 34 is a schematic view for illustrating the cleaning container 24 on which the receptor sheet 15 is welded on the elastomer member 10.

In this embodiment, the receptor sheet 15 formed of polyester with a thickness of 38 μm and a light transmittance of 85% (near infrared ray of 960 nm) was used. First, as shown in (a) of FIG. 29, when the receptor sheet 15 is mounted on the cleaning container 24, waving x as shown in (b) of FIG. 29, can occur at the edge (contact portion with the image bearing member 21) 15*a* of the receptor sheet 15 due to creases of the receptor sheet 15 itself, an environmental fluctuation, and the like. For this reason, when the receptor sheet 15 is mounted, as shown in (a) of FIG. 30, the two longitudinal end portions 15*c* and 15*d* of the receptor sheet 15 in the upper edge 15*a* side are pulled in the arrow L1 and L2 directions by an unshown sheet-pulling jig. In this state, by mounting the receptor sheet 15 on the sheet member mounting surface 24*d* of the cleaning container 24, an initial tension amount n is provided to the edge 15*a* of the receptor sheet 15 as shown in (b) of FIG. 30, so that waving is prevented. In this embodiment, the initial tension amount n of about 0.3 mm is provided.

As shown in FIGS. 31 to 33 in a state in which the tension is applied to the edge 15*a* of the receptor sheet 15 by using the unshown pulling jig, the receptor sheet 15 is superposed on the sheet member mounting surface 24*d* in its lower edge side so as to be contacted to the sheet member mounting surface 24*d*. Further, the receptor sheet 15 is press-contacted to a sheet regulating surface (regulating portion) 49 for regulating a sheet position by using an urging jig 45, which is transparent to near infrared ray, from above the receptor sheet 15. As a result, the receptor sheet 15 is temporarily positioned so that a position of the receptor sheet 15 relative to the cleaning container 24 is not shifted (deviated) during bonding of the receptor sheet 15.

Thereafter, laser light e of near infrared ray is emitted from a laser irradiation head 60, via the receptor sheet 15, toward the sheet member mounting surface 24*d* of the elastomer member 10 formed on the cleaning container 24 by molding. The elastomer member 10 contains carbon black so as to absorb near infrared ray. For this reason, the emitted laser light e passes through the urging jig 45 and the receptor sheet 15 which are transparent to near infrared ray, and is absorbed by the sheet member mounting surface 24*d* of the elastomer member 10 formed on the cleaning container 24 by molding. The laser light absorbed by the sheet member mounting surface 24*d* is conversed into heat and thus the sheet member mounting surface 24*d* generates heat, so that the elastomer member 10 is melted at its edge portion by the heat and thus can be welded with (bonded to) the edge portion 15*b* of the receptor sheet 15 contacting the sheet member mounting surface 24*d*. After the (heat) welding, the urging jig 45 is disconnected, so that the elastomer member 10 is released from the compressed state and is then elastically restored in the urging direction, thus being increased in height. As a result, the contact position between the elastomer member 10 and the receptor sheet 15 becomes higher than the height of the sheet regulating surface 49.

Here, the laser light e emitted from the irradiation head 60 was focused to a circular spot of 1.5 mm in diameter when it reaches the sheet member mounting surface 24*d*. That is a spot diameter of the laser light is 1.5 mm. Further, by making a molding width of the elastomer member smaller than 1.5 mm, it becomes possible to uniformly melt the sheet member mounting surface 24*d* of the elastomer member 10. Therefore, in this embodiment, a melting width e1 of the elastomer member 10 is about 1.0 mm. Further, the receptor sheet 15 is irradiated with the laser light continuously from its end portion to its another end portion. As a result, a welded surface g1 continuously extending in the longitudinal direction as shown in FIG. 34 can be obtained.

Further, as the urging jig 45, a member having a rigidity such that it can press an entire contact surface between the receptor sheet 15 and the sheet member mounting surface 24*d* of the elastomer member 10 formed on the cleaning container 24 by molding may preferably be used. Specifically, acrylic resin, glass and the like may preferably be used.

Further, the cleaning container 24 on which the elastomer member 10 having the sheet member mounting surface 24*d* is formed by molding is formed of the resin material, so that when the receptor sheet 15 is mounted, the sheet member mounting surface 24*d* is curved to cause some unevenness or deformation in some cases. Further, in some cases, the position of the receptor sheet 15 relative to the cleaning container 24 is shifted. Therefore, in this embodiment, the urging jig 45 was provided with an elastic urging member 47. By the urging member 47, the receptor sheet 15 is elastically urged toward the cleaning container 24 to be temporarily positioned, so that an adhesive property between the receptor sheet 15 and the sheet member mounting surface 24*d* can be improved. Further, positional deviation of the receptor sheet 15 can be prevented. Specifically, as the urging jig 45, a member including an acrylic member 46 as a rigid member and a 5 mm-thick silicone rubber member (urging member) 47 as an elastic member which are bonded with a transparent double-side tape was used.

Further, as the elastomer member 10, a member prepared by incorporating 0.5 to 12.0 wt. parts of carbon black into 100 wt. parts of the styrene-based elastomer resin material was used.

The above-described bonding method between the receptor sheet 15 and the elastomer member 10 formed on the cleaning container 24 by molding can also be applied to welding between the blow off preventing sheet 16 and the elastomer member 11 formed on the developing container 71 by molding. Similarly, the bonding method is also applicable to bonding between the charging roller cleaner 17 and the elastomer member 12 formed on the cleaning container 24 by molding. Further, the bonding method is also applicable to welding between the scattering preventing sheet 18 and the elastomer member 13 formed on the developing container 71 by molding. Further, in this embodiment, the receptor sheet 15 having the light transmittance of 85% or less may also be weldable. Further, as a method other than the welding (bonding) method in this embodiment, the elastomer member 10 and the receptor sheet 15 may also be welded by heat seal or the like. Incidentally, by the heat seal or the like, heat cannot be applied to only a bonded interface between the receptor sheet 15 and the elastomer member 10 but is conducted (applied) from an upper surface of the receptor sheet 15. Therefore, there is also a need to take a heat conduction time and melting of the receptor sheet 15 into consideration.

With reference to FIGS. 35 and 36, a cross-sectional shape after the sheet member welding in this embodiment of the present invention will be described. FIG. 35 is a schematic sectional view of a welding portion when the receptor sheet 15 is mounted on the cleaning container 24. FIG. 36 is a schematic sectional view showing a state in which the receptor sheet 15 is contacted to the regulating portion 49*a* of the sheet regulating surface 49.

First, as shown in FIG. 35, welding burrs z are generated on the elastomer member 10, so that the receptor sheet 15 is partly provided with curvature (arcuate shape), thus being placed in a state of welding on the elastomer member 10 in some cases. In this state, the receptor sheet 15 is falls in its edge 15*a* side in an arrow a direction shown in FIG. 36, so that it is difficult to ensure accuracy of the receptor sheet edge 15*a*. Therefore, as shown in FIG. 36, the receptor sheet 15 is contacted to the sheet regulating surface 49 with respect to the longitudinal direction, so that the falling in the arrow a direction of the receptor sheet 15 with respect to the widthwise direction is prevented and thus it becomes possible to stabilize the position of the edge 15*a* of the receptor sheet 15. At this time, in order to bring the receptor sheet 15 into contact with the sheet regulating surface 49, there is a need to provide a spacing p1 between the elastomer member 10 and the cleaning container 24 to same extent. This is because in the case where the spacing p1 is narrow and a welding surface height y is large, the receptor sheet 15 is not contacted to the sheet regulating surface 49 and falls in the arrow a direction.

In this embodiment, the welding surface height y was 0.05 to 0.15 mm and therefore in order to bring the receptor sheet 15 into contact with the regulating portion 49*a* of the sheet regulating surface 49, the spacing p1 was 0.75 to 1.05 mm. At this time, an angle b formed between the receptor sheet 15 and the sheet regulating surface 49 was 1 to 2 degrees.

Incidentally, the above-described sheet regulating structure is not limited to that described above so long as the sheet regulating surface 49 is contactable to the receptor sheet 15 so that the position of the edge 15*a* of the receptor sheet 15 is regulated at a position where the edge 15*a* contacts the image bearing member 21. Further, the receptor sheet 15 may preferably be contacted to the sheet position regulating surface 49 over an entire longitudinal region but may also be partly contacted to the sheet position regulating portion 49.

In the above, the shape when the receptor sheet 15 is welded on the elastomer member 10 formed on the cleaning container 24 by molding was described. However, the shape in Embodiment 2 is also applicable to the shape when the blowoff preventing sheet 16 is welded on the elastomer member 11 formed on the developing container 71 by molding. Further, the shape is also applicable to the shape when the charging roller cleaner 17 is welded on the elastomer member 12 formed on the cleaning container 24 by molding. In addition, the shape is also applicable to the shape when the scattering preventing sheet 18 is welded on the elastomer member 13 formed on the developing container 71 by molding.

As described above, according to Embodiment 2, the elastomer member is directly formed on the frame by molding, so that assembling of the elastomer member with high accuracy can be effected. Further, according to the sheet regulating structure described above, irrespective of the welding state (the shape of the welding portion after the welding) between the elastomer member and the sheet member (thin plate member), tilting of the sheet member in the widthwise direction can be prevented and thus it is possible to stabilize the edge position of the sheet member.

Embodiment 3

Next, Embodiment 3 of the present invention will be described. Members or portions common to Embodiments 1 and 3 will be omitted from description.

The elastomer member formed on the frame by molding in this embodiment specifically has a shape as shown in FIG. 24 such that dimensions thereof are h=0.6 to 0.8 mm, i=0.1 to 0.3 mm, j=1.0 mm, k=0.3 mm and r=1.6 mm. Here, h is a height of the elastomer member during molding, i is an elastomer member melting margin for permitting melting of the elastomer resin material by laser molding during sheet member bonding, j is an elastomer member molding width (upper side), k is an entering amount of the elastomer member entering the container, and r is an elastomer member molding width (bottom side). In such a dimensional constitution, a section modulus is about 0.25.

As shown in (a) of FIG. 37, a cross-sectional shape (excluding a portion where the elastomer member 10 enters the cleaning container 24) perpendicular to (crossing) the longitudinal direction in a region in which the elastomer member 10 is to be compressed (pressed) between the cleaning container 24 and the receptor sheet 15 is made trapezoidal. As a result, buckling of the elastomer member during compression can be prevented. Parts (a), (b), (a-1) and (b-1) of FIG. 37 are schematic sectional views for illustrating a molded shape effect of the elastomer member in this embodiment in which (a) shows a state before compression in the case where the cross-sectional shape is trapezoidal, (b) shows a state during compression in the case where the cross-sectional shape is trapezoidal (a-1) shows a state before compression in the case where the cross-sectional shape is rectangular, and (b-1) shows a state during compression in the case where the cross-sectional shape in rectangular. That is, as shown in (a-1) and (b-1), in the case where the cross-sectional shape of the elastomer member 10 is rectangular, buckling is generated, so that deformation such that the elastomer member 10 acts violently with respect to a direction (q2 direction) perpendicular to a compression direction (q1 direction) when the elastomer member 10 is compressed and thus an attitude of the elastomer member 10 is not stabilized. In such a state, welding of the receptor sheet 15 becomes insufficient and thus deviation is generated at the welding surface, so that tilting or the like of the receptor sheet 15 after the welding is generated. On the other hand, as shown in (a) and (b) of FIG. 37, the cross-sectional shape is made trapezoidal such that its width is gradually increased with respect to the compression direction, whereby shape stability during the compression can be enhanced to suppress the generation of buckling.

The cross-sectional shape of the elastomer member is not limited to the trapezoidal shape so long as the shape has high shape stability during the compression. That is, the cross-sectional shape of the elastomer member in a region where the elastomer member is compressed between the thin plate member and the frame to cause deformation may only be required to be increased, in width with respect to the direction perpendicular to the compression direction, from the thin plate member size to the frame side. Parts (a) to (d) of FIG. 38 show modified examples of the above-described cross-sectional shape of the elastomer member. Next, the material for forming the frame is HIPS (high-impact polystyrene) and its linear expansion coefficient is 0.000087 (1/° C.), and an elastic modulus of the material is 2.38 GPa. The material for the sheet member is polyester and is 38 μm in thickness, 0.000015 (1/° C.) in linear expansion coefficient and 4.5 GPa in elastic modulus. That is, a degree of temperature change of the frame is about 5.8 times that of the sheet member. Therefore, when a left-standing environment is changed from normal temperature (e.g., 23° C.) to 50° C., a load corresponding to a difference in elongation between the frame and the sheet member is applied to the elastomer member sandwiched between the frame and the sheet member. This load is a difference in displacement between the frame and the sheet member in the 50° C. environment. In the case where the displacement under the 50° C. environment is calculated, the elongation amount of the frame (having a full length of 220 mm equal to that of the sheet member) is 0.52 mm and the elongation amount of the sheet member is 0.09 mm, so that the elongation difference Δ is 0.43 mm.

As described above, by making the elastic modulus of the elastomer member being a range, of 2.5 MPa or more and 10 MPa or less, which is smaller than the elastic modulus of the sheet member, it is possible to decrease the amount of permanent deformation of the elastomer member, due to the load under the 50° C. environment, at the time when the ambient temperature is restored to normal temperature. Further, each of the bonded interface between the frame and the elastomer member and the bonded interface between the sheet member and the elastomer member is formed by molding and welding and therefore no deviation is generated, so that the initial tension of the sheet member can be maintained. As a result, it becomes possible to prevent the waving of the sheet member.

As described above, according to Embodiment 1, the elastomer member is directly formed on the frame by molding and therefore it is possible to effect assembling with a higher degree of accuracy than that in the case of the double-side tape. Further, the deviation of the bonded interface, generated in the case of using the double-side tape, between the frame and the double-side tape after being left standing in the high temperature environment can be eliminated. Further, by bonding the sheet member and the elastomer member to each other by welding, it is possible to eliminate the deviation of the bonded interface, generated in the case of using the double-side tape as the adhesive member, between the sheet member and the double-side tape after being left standing in the high temperature environment. Further, by making the elastic modulus of the elastomer member smaller than the elastic modulus of the frame or the sheet member, the amount of permanent deformation of the elastomer member after being left standing in the high temperature environment can be made small. Further, there are no deviations of the bonded interface between the frame and the elastomer member and the bonded interface between the sheet member and the elastomer member, and therefore the initial tension of the sheet member can be maintained, so that the waving of the sheet member can be prevented.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 245731/2011 filed Nov. 9, 2011; 275772/

2011 filed Dec. 16, 2011; and 275773/2011 filed Dec. 16, 2011, which are hereby incorporated by reference.

What is claimed is:

1. A unit for use with an image forming apparatus, the unit comprising:

a developer accommodating portion, constituted by a frame, for accommodating a developer;

a sheet member, provided on the frame in contact with a rotatable member, for preventing the developer from leaking out from a gap between said developer accommodating portion and the rotatable member; and a resin member for fixing said sheet member on the frame, wherein said resin member is formed on the frame by injection molding of a resin material and is fixed to said sheet member by welding, the resin material having an elastic modulus that is less than that of the frame.

2. A unit according to claim 1, wherein said resin member has an elastic modulus that is less than that of said sheet member.

3. A unit according to claim 1, wherein said sheet member is welded on said resin member by heating.

4. A unit according to claim 1, wherein said resin member contains carbon black for absorbing near infrared rays, wherein said sheet member is formed of a material capable of transmitting the near infrared rays, and said sheet member is welded on said resin member by heat generation of said resin member through absorption of the near infrared rays.

5. A unit according to claim 1, wherein the frame includes a regulating portion for regulating, when said resin member is compressed to weld said sheet member thereon, a position of said sheet member with respect to a direction perpendicular to a contact surface at which said sheet member and said resin member contact, and wherein the regulating portion is spaced from said sheet member after said sheet member is welded on said resin member.

6. A unit according to claim 1, wherein said resin member is formed at a recessed portion, provided on the frame, by the injection molding.

7. A unit according to claim 1, wherein said resin member is free from contacting the frame at a position other than a position at which said resin member contacts the frame, when said resin member is formed on the frame by the injection molding.

8. A unit according to claim 1, wherein said sheet member is welded on said resin member at one widthwise end portion and contacts the rotatable member at another widthwise end portion, and wherein the frame includes a regulating portion contacting a position between the one widthwise end portion and another widthwise end portion of said sheet member, so that said sheet member contacts the rotatable member at the one widthwise end portion.

9. A unit according to claim 8, wherein the regulating portion contacts said sheet member welded, at the one widthwise end portion, on an arcuate end portion of said resin member.

10. A unit according to claim 1, wherein said sheet member is welded on said resin member along a longitudinal direction of said resin member, and wherein said resin member has a cross-sectional shape, with respect to a direction crossing the longitudinal direction, which increases from a side at which the resin member contacts said sheet member toward a side at which said resin member is fixed on the frame.

11. A unit according to claim 10, wherein said resin member has a trapezoidal shape.

12. A unit according to claim 1, wherein the rotatable member is an image bearing member, and wherein said developer accommodating portion accommodates the developer removed from the image bearing member.

13. A unit according to claim 1, wherein the rotatable member is a developer carrying member for developing an electrostatic latent image formed on an image bearing member, and wherein said developer accommodating portion accommodates the developer used on the developer carrying member.

14. A unit according to claim 1, which is detachably mountable to the image forming apparatus.

15. An image forming apparatus for forming an image on a recording material, the image forming apparatus comprising:

a developer accommodating portion, constituted by a frame, for accommodating a developer;

a sheet member, provided on the frame in contact with a rotatable member, for preventing the developer from leaking out from a gap between said developer accommodating portion and the rotatable member; and a resin member for fixing said sheet member on the frame, wherein said resin member is formed on the frame by injection molding of a resin material and is fixed to said sheet member by welding, the resin material having an elastic modulus that is less than that of the frame.

16. A unit according to claim 1, wherein said resin member is an elastomer.

17. A unit for use with an image forming apparatus, the unit comprising:

a developer accommodating portion, constituted by a frame, for accommodating a developer;

a sheet member, provided on the frame in contact with a rotatable member, for preventing the developer from leaking out from a gap between said developer accommodating portion and the rotatable member; and a resin member for fixing said sheet member on the frame, wherein said resin member, for absorbing a difference in linear expansion by heat between said frame and said sheet member, is formed on the frame by injection molding of a resin material and is fixed to said sheet member by welding.

18. A unit according to claim 17, wherein said resin member has an elastic modulus that is less than that of said sheet member.

19. A unit according to claim 17, wherein said sheet member is welded on said resin member by heating.

20. A unit according to claim 17, wherein said resin member contains carbon black for absorbing near infrared rays, wherein said sheet member is formed of a material capable of transmitting the near infrared rays, and said sheet member is welded on said resin member by heat generation of said resin member through absorption of the near infrared rays.

21. A unit according to claim 17, wherein the frame includes a regulating portion for regulating, when said resin member is compressed to weld said sheet member thereon, a position of said sheet member with respect to a direction perpendicular to a contact surface at which said sheet member and said resin member contact, and wherein the regulating portion is spaced from said sheet member after said sheet member is welded on said resin member.

22. A unit according to claim 17, wherein said resin member is formed at a recessed portion, provided on the frame, by the injection molding.

23. A unit according to claim 17, wherein said resin member is tree from contacting the frame at a position other than a position at which said resin member contacts the frame, when said resin member is formed on the frame by the injection molding.

24. A unit according to claim 17, wherein said sheet member is welded on said resin member at one widthwise end portion and contacts the rotatable member at another widthwise end portion, and wherein the frame includes a regulating portion contacting a position between the one widthwise end portion and the another widthwise end portion of said sheet member, so that said sheet member contacts the rotatable member at the one widthwise end portion.

25. A unit according to claim 24, wherein the regulating portion contacts said sheet member welded, at the one widthwise end portion, on an arcuate end portion of said resin member.

26. A unit according to claim 17, wherein said sheet member is welded on said resin member along a longitudinal direction of said resin member, and wherein said resin member has a cross-sectional shape, with respect to a direction crossing the longitudinal direction, which increases from a side at which the resin member contacts said sheet member toward a side at which said resin member is fixed on the frame.

27. A unit according to claim 26, wherein said resin member has a trapezoidal shape.

28. A unit according to claim 17, wherein the rotatable member is an image bearing member, and wherein said developer accommodating portion accommodates the developer removed from the image bearing member.

29. A unit according to claim 17, wherein the rotatable member is a developer carrying member for developing an electrostatic latent image formed on an image bearing member, and wherein said developer accommodating portion accommodates the developer used on the developer carrying member.

30. A unit according to claim 17, the unit being detachably mountable to the image forming apparatus.

31. A unit according to claim 17, wherein said resin member is an elastomer.

32. An image forming apparatus for forming an image on a recording material, the image forming apparatus comprising:

a developer accommodating portion, constituted by a frame, for accommodating a developer;

a sheet member, provided on the frame in contact with a rotatable member, for preventing the developer from leaking out from a gap between said developer accommodating portion and the rotatable member; and a resin member for fixing said sheet member on the frame, wherein said resin member, for absorbing a difference in linear expansion by heat between said forme and said sheet member, is formed on the frame by injection molding of a resin material and is fixed to said sheet member by welding.

* * * * *